US009176423B2

(12) United States Patent
Ota

(10) Patent No.: US 9,176,423 B2
(45) Date of Patent: Nov. 3, 2015

(54) DEVELOPER CONTAINER, DEVELOPMENT DEVICE, AND IMAGE FORMATION APPARATUS THAT HAVE SHUTTER MOVEMENT RESTRICTION MEMBER TO RESTRICT MOVEMENT OF SHUTTER MEMBER

(71) Applicant: Oki Data Corporation, Tokyo (JP)

(72) Inventor: Atsushi Ota, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 14/157,573

(22) Filed: Jan. 17, 2014

(65) Prior Publication Data

US 2014/0205328 A1 Jul. 24, 2014

(30) Foreign Application Priority Data

Jan. 21, 2013 (JP) ..... 2013-008627

(51) Int. Cl.
*G03G 15/08* (2006.01)

(52) U.S. Cl.
CPC ..... *G03G 15/0886* (2013.01)

(58) Field of Classification Search
CPC ..... G03G 15/0877; G03G 21/1832
USPC ..... 399/260
See application file for complete search history.

(56) References Cited

U.S. PATENT DOCUMENTS

| | | | | |
|---|---|---|---|---|
| 7,174,120 | B2 * | 2/2007 | Koyama et al. | 399/258 |
| 7,245,860 | B2 * | 7/2007 | Huang et al. | 399/262 |
| 7,421,234 | B2 * | 9/2008 | Ikeda et al. | 399/262 |
| 7,558,515 | B2 * | 7/2009 | Kurita et al. | 399/262 |
| 7,747,199 | B2 * | 6/2010 | Koido | 399/262 |
| 7,853,183 | B2 * | 12/2010 | Taguchi et al. | 399/262 |
| 8,200,127 | B2 * | 6/2012 | Nozawa | 399/262 |
| 2006/0008298 | A1 * | 1/2006 | Koyama | 399/258 |
| 2009/0238609 | A1 | 9/2009 | Koido | |

FOREIGN PATENT DOCUMENTS

| | | | |
|---|---|---|---|
| CN | 101539744 | A | 9/2009 |
| EP | 2110713 | A2 | 10/2009 |
| JP | 2009-229561 | A | 10/2009 |

* cited by examiner

*Primary Examiner* — Billy Lactaoen

*Assistant Examiner* — Arlene Heredia Ocasio

(74) *Attorney, Agent, or Firm* — Marvin A. Motsenbocker; Mots Law, PLLC

(57) ABSTRACT

A developer container includes: a developer container body including a developer supply port and a first shutter movement restriction groove on a surface of the developer container body; a shutter member movable from a close position to an open position of the developer supply port, the shutter member including a second shutter movement restriction groove such that the first and second shutter restriction grooves define a guide path when the shutter member closes the developer supply port at the close position; and a restriction member movable in the guide path and configured, when the restriction member is positioned in both the first and second shutter movement restriction grooves depending on an inclination of the developer container body, to prevent the shutter member from moving from the close position to the open position.

19 Claims, 31 Drawing Sheets

DEVELOPER CONTAINER, DEVELOPMENT DEVICE, AND IMAGE FORMATION APPARATUS THAT HAVE SHUTTER MOVEMENT RESTRICTION MEMBER TO RESTRICT MOVEMENT OF SHUTTER MEMBER

CROSS REFERENCE TO RELATED APPLICATIONS

This application claims priority based on 35 USC 119 from prior Japanese Patent Application No. 2013-008627 filed on Jan. 21, 2013, entitled "DEVELOPER CONTAINER, DEVELOPMENT DEVICE, AND IMAGE FORMATION APPARATUS", the entire contents of which are incorporated herein by reference.

BACKGROUND OF THE INVENTION

1. Field of the Invention

The disclosure relates to a developer container, a development device, and an image formation apparatus.

2. Description of Related Art

Electronic photographic printers, copiers, facsimile devices, multifunction machines, and the like are examples of types of conventional image formation apparatuses. In such image formation apparatuses, for example, in a printer, color development units are mounted as development devices. Each of the color development units includes a photosensitive drum, a charge roller, a development device, and the like. In the color development unit, the surface of the photosensitive drum is evenly charged by the charge roller and is exposed to light by a LED head to form an electrostatic latent image. The development device develops the electrostatic latent image to form a toner image. A transfer roller transfers the toner image onto a paper sheet and a fuser unit fixes the toner image to form an image. In such a way, the printer makes printing.

In the development unit, a toner cartridge as the developer container is detachably mounted to supply toner as a developer into the development device. For this purpose, the toner cartridge has a toner supply port as a developer supply port formed on a bottom surface of the toner cartridge. A shutter having an opening is provided to open and close the toner supply port. With this configuration, the toner supply port can be opened when the shutter is moved to cause the opening to meet or match up with the toner supply port.

For example, Patent Document 1 (Japanese Patent Application Publication No. 2009-229561) discloses a toner cartridge or a powder container that includes a shutter movement restriction member for prohibiting a shutter from moving when a toner supply port faces upward. This is to prevent foreign matter from entering the inside of the toner cartridge by a careless operation.

SUMMARY OF THE INVENTION

In the Patent Document 1, however, the shutter movement restriction member works only when the toner supply port faces upward in a vertical direction.

Accordingly, a conventional toner cartridge does not completely prevent a shutter from moving when the toner cartridge is inclined within an angle range where the toner supply port turns from a substantially horizontal position to substantially upside in a vertical position. For this reason, there is a possibility that the operator will accidently open the toner supply port by performing a careless operation of the toner cartridge by inclining the cartridge within the above range and thereby scatters the toner into the surroundings.

An aspect of the invention is a developer container that includes: (1) a developer container including a developer container body with a developer supply port and a first shutter movement restriction groove on a surface of the developer container body; (2) a shutter member movable from a closed position to an open position of the developer supply port, wherein the shutter member includes a second shutter movement restriction groove such that the first and second shutter restriction grooves define a guide path when the shutter member closes the developer supply port in the closed position; and (3) a restriction member that is movable in the guide path and is configured to prevent the shutter member from moving from the close position to the open position when the restriction member is positioned in both the first and second shutter movement restriction grooves depending on an inclination of the developer container body.

According to this aspect, it is possible to prevent a careless operation from opening the toner supply port and this thereby prevents the scattering of the toner into the surroundings.

DETAILED DESCRIPTION OF EMBODIMENTS

Figure 1:
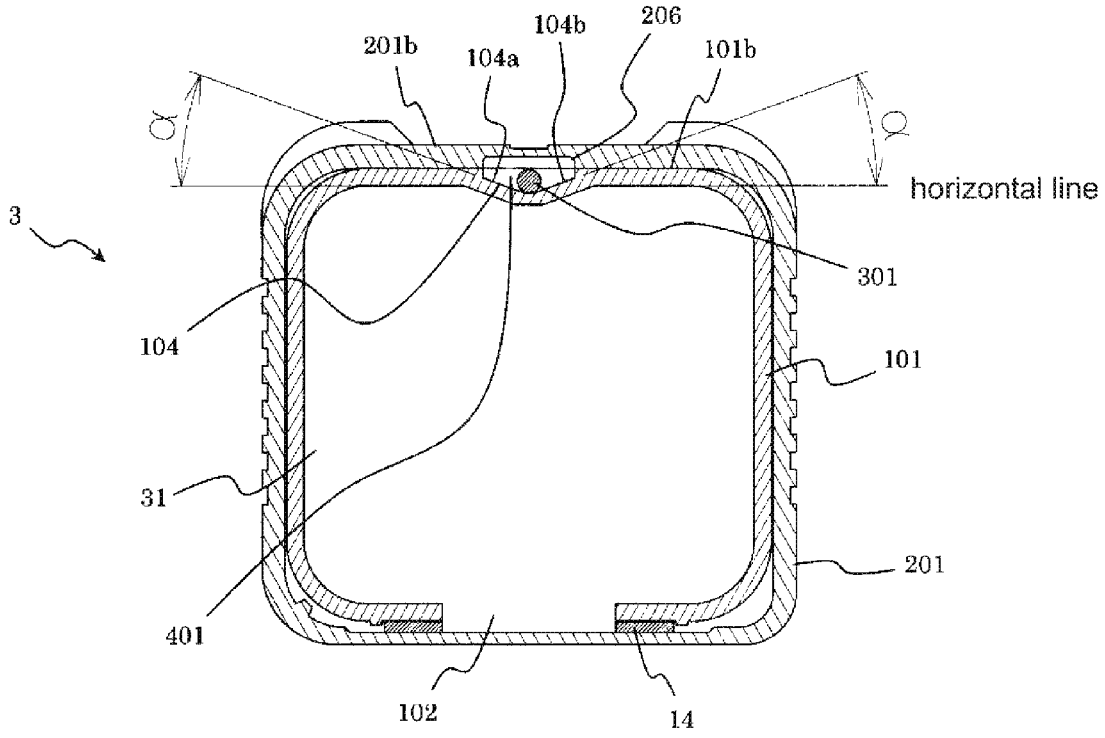
FIG. 1 is a cross sectional view illustrating a key part of a shutter movement restriction unit according to a first embodiment of the invention.

Descriptions are provided hereinbelow for embodiments based on the drawings. In the respective drawings referenced herein, the same constituents are designated by the same reference numerals and duplicate explanation concerning the same constituents is omitted. All of the drawings are provided to illustrate the respective examples only.

Hereinafter, embodiments of the invention are described in detail with reference to the accompanying drawings. In the embodiments, an electrophotographic printer is described as an example of an image formation apparatus.

First Embodiment

Figure 2:
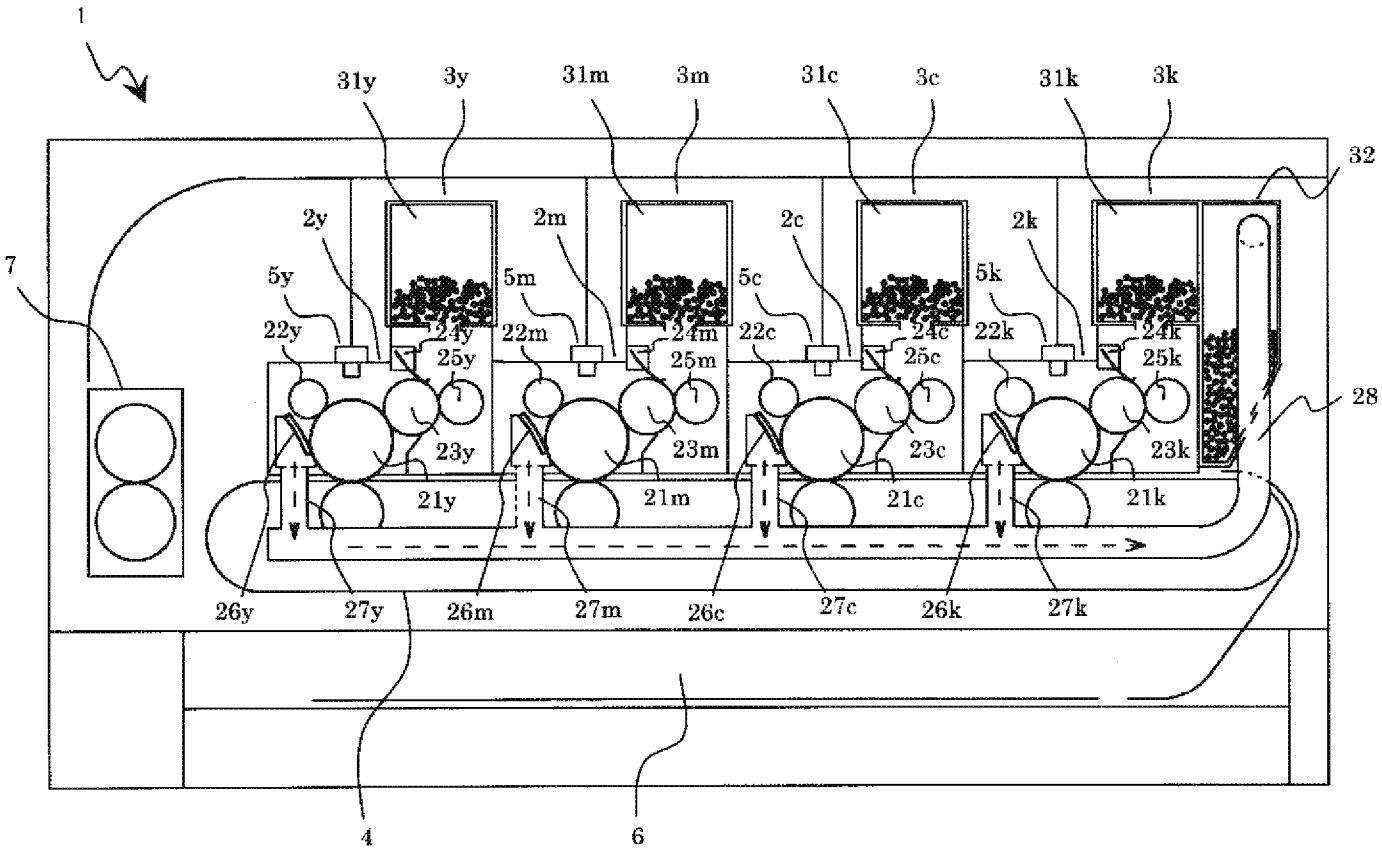
FIG. 2 is a schematic configuration diagram illustrating an electrophotographic printer according to the first embodiment.

FIG. 2 is a schematic configuration diagram illustrating an electrophotographic printer according to the first embodiment.

As illustrated in FIG. 2, electrophotographic printer 1 includes: development units 2*k*, 2*c*, 2*m*, and 2*y* for the colors of black (K), cyan (C), magenta (M), and yellow (Y); toner cartridges 3*k*, 3*c*, 3*m*, and 3*y* serving as developer containers for storing toner of the respective colors as developers; transfer unit 4; LED heads 5*k*, 5*c*, 5*m*, and 5*y* serving as exposure devices; paper feed cassette 6 configured to store and feed recording media to development device 2; and fuser unit 7 configured to fix a toner image onto a recording medium.

Development units 2*k*, 2*c*, 2*m*, and 2*y* have the same construction and are arranged in that order from a feeding side of the recording medium (the right side in FIG. 2) to a discharge side thereof (on the left side in FIG. 2) along transfer unit 4. Development units 2*k*, 2*c*, 2*m*, and 2*y* are united as development device 2, which is detachably mounted to a body of electrophotographic printer 1.

Development units 2*k*, 2*c*, 2*m*, and 2*y* include: photosensitive drums 21*k*, 21*c*, 21*m*, and 21*y*, serving as image carriers; charge roller 22*k*, 22*c*, 22*m*, and 22*y* configured to charge photosensitive drums 21*k*, 21*c*, 21*m*, and 21*y*; development rollers 23*k*, 23*c*, 23*m*, and 23*y* configured to develop electrostatic latent images formed by LED heads 5*k*, 5*c*, 5*m*, and 5*y* on the photosensitive drums; development blades 24*k*, 24*c*, 24*m*, and 24*y* configured to form toner layers on development rollers 23*k*, 23*c*, 23*m*, and 23*y*; supply rollers 25*k*, 25*c*, 25*m*, and 25*y* configured to supply the toner to development rollers 23*k*, 23*c*, 23*m*, and 23*y*; cleaning blades 26*k*, 26*c*, 26*m*, and 26*y* configured to remove untransferred residual toner on the photosensitive drums; and first conveyors 27*k*, 27*c*, 27*m*, and 27*y*.

Toner cartridges 3*k*, 3*c*, 3*m*, and 3*y* include toner containers 31*k*, 31*c*, 31*m*, and 31*y* configured to store unused toners. Toner cartridges 3*k*, 3*c*, 3*m*, and 3*y* are disposed above corresponding development units 2*k*, 2*c*, 2*m*, and 2*y*. Toner cartridges 3*k*, 3*c*, 3*m*, and 3*y* are configured to be independently detachable from development units 2*k*, 2*c*, 2*m*, and 2*y*.

Development device 2, in which development units 2*k*, 2*c*, 2*m*, and 2*y* are united, includes second conveyor 28.

Each of first conveyors 27*k*, 27*c*, 27*m*, and 27*y* includes, for example, a coil spiral configured to convey waste toner in an axial direction of the photosensitive drum toward the front side of FIG. 2, with the waste toner being removed from a surface of the photosensitive drum by the corresponding one of cleaning blades 26*k*, 26*c*, 26*m*, and 26*y*.

Second conveyor 28 is configured to collectively convey the waste toner conveyed by first conveyors 27*k*, 27*c*, 27*m*, and 27*y*, to waste toner reclaim container 32 as a toner reclaim device disposed most upstream in the arrangement direction of development units 2*k*, 2*c*, 2*m*, and 2*y*.

Waste toner reclaim container 32 is configured to store the waste toner conveyed by second conveyor 28.

Development device 2 and toner cartridges 3*k*, 3*c*, 3*m*, and 3*y* are replaceable individually. Therefore, development device 2 and toner cartridges 3*k*, 3*c*, 3*m*, and 3*y* can be replaced individually when toner is consumed or when their lifetime expires due to deterioration of a component thereof.

Next, development device 2, in which development units 2*k*, 2*c*, 2*m*, and 2*y* are united, and toner cartridges 3*k*, 3*c*, 3*m*, and 3*y* are described.

Figure 3:
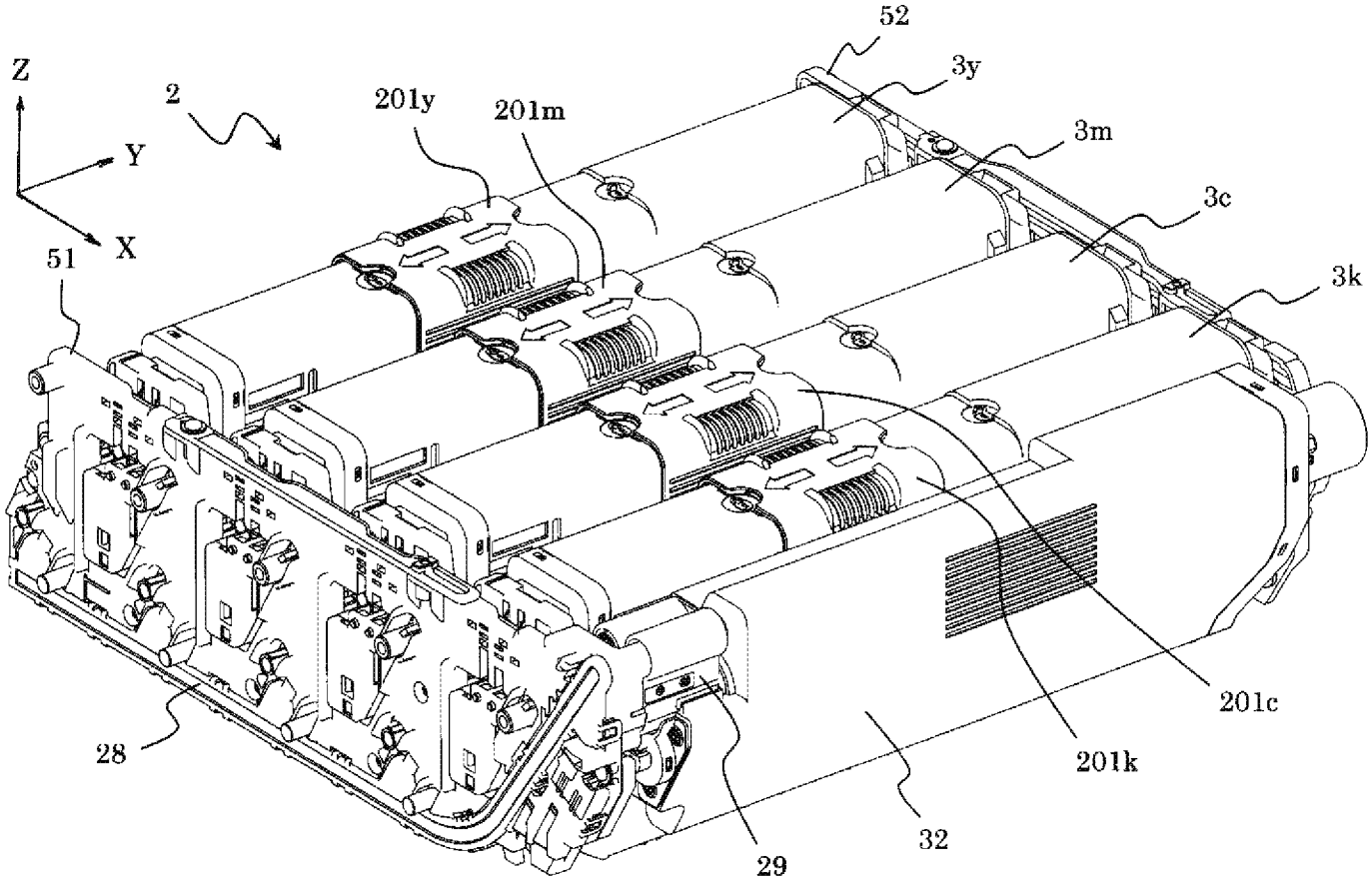
FIG. 3 is an external perspective view of a development device according to the first embodiment in which a toner cartridge is mounted.
Figure 4:
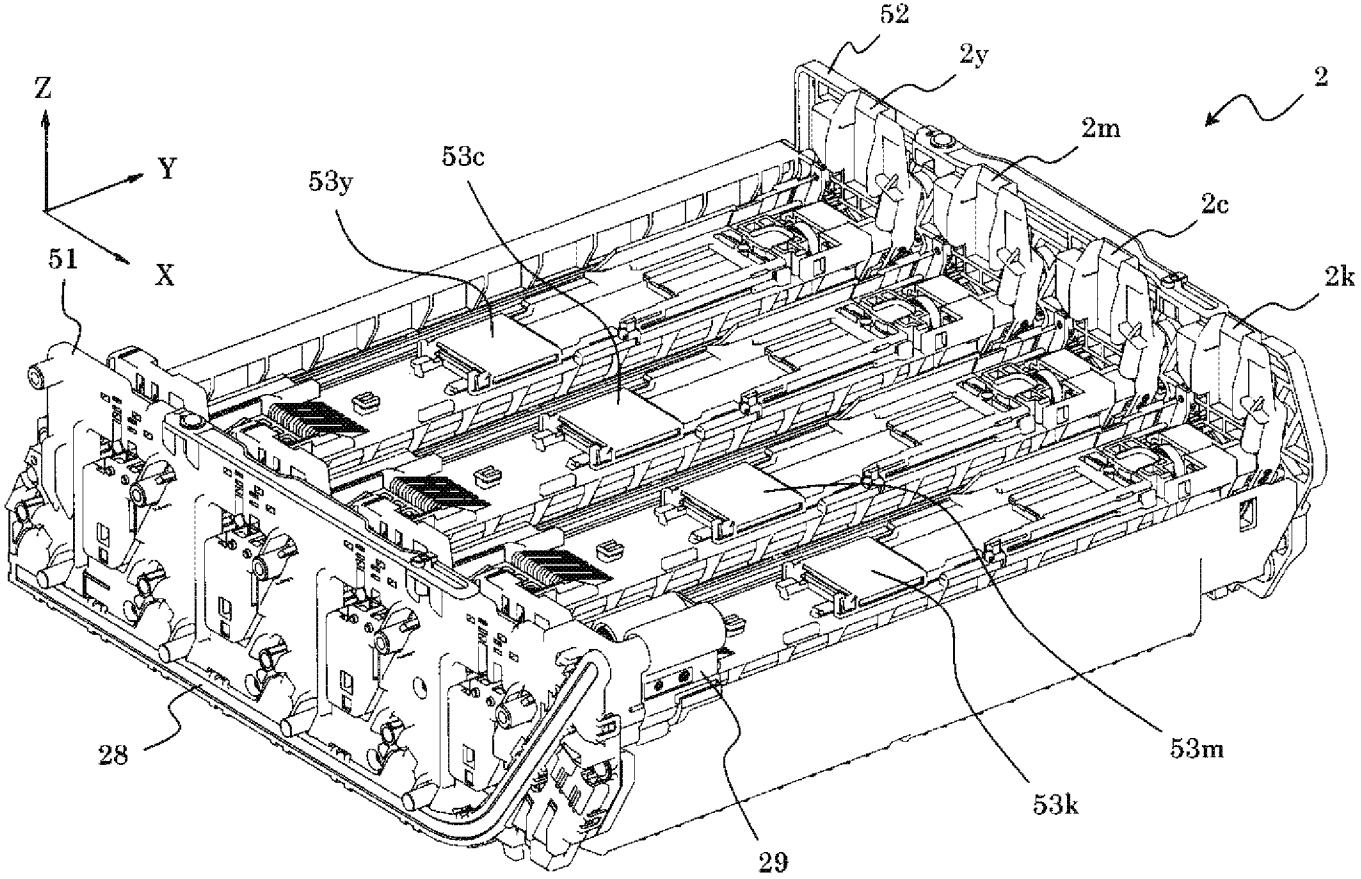
FIG. 4 is an external perspective view of the development device in which the toner cartridge is not mounted.

FIG. 3 is an external perspective view of the development device in which toner cartridges are mounted according to the first embodiment. FIG. 4 is an external perspective view of the development device in which the toner cartridges are not mounted.

As illustrated in FIGS. 3 and 4, development units 2*k*, 2*c*, 2*m*, and 2*y* are arranged at equal pitches in development device 2. First side frame body 51 and second side frame body 52, both of which have a high rigidity, are provided on both sides of development device 2 (both sides in the longitudinal direction of each of development units 2*k*, 2*c*, 2*m*, and 2*y* (Y axis direction)). Development units 2*k*, 2*c*, 2*m*, and 2*y* are united by being fixed from both sides by first side frame body 51 and second side frame body 52.

Upper portions of development units 2*k*, 2*c*, 2*m*, and 2*y* are provided with toner receiving ports for receiving toner from toner cartridges 3*k*, 3*c*, 3*m*, and 3*y*, respectively. The toner receiving ports are covered with receiving port shutter members 53*k*, 53*c*, 53*m*, and 53*y*, respectively. Receiving port shutter members 53*k*, 53*c*, 53*m*, and 53*y* are configured to engage with shutter members 201*k*, 201*c*, 201*m*, and 201*y* of toner cartridges 3*k*, 3*c*, 3*m*, and 3*y*. For example, receiving port shutter members 53*k*, 53*c*, 53*m*, and 53*y* include engagement ribs (not illustrated) configured to respectively engage with shutter members 201*k*, 201*c*, 201*m*, and 201*y* of toner cartridges 3*k*, 3*c*, 3*m*, and 3*y* so that receiving port shutter members 53*k*, 53*c*, 53*m*, and 53*y* and shutter members 201*k*, 201*c*, 201*m*, and 201*y* can interlock with each other. With this configuration, when toner cartridges 3*k*, 3*c*, 3*m*, and 3*y* are mounted, shutter members 201*k*, 201*c*, 201*m*, and 201*y* of toner cartridges 3*k*, 3*c*, 3*m*, and 3*y* and receiving port shutter members 53*k*, 53*c*, 53*m*, and 53*y* are engaged and interlock with each other so as to open and close toner supply ports 102 of toner cartridges 3 and the toner receiving ports of development units 2*k*, 2*c*, 2*m*, and 2*y*.

First side frame body 51 includes second conveyor 28. Second conveyor 28 is connected with first conveyors 27*k*, 27*c*, 27*m*, and 27*y* of development units 2*k*, 2*c*, 2*m*, and 2*y*, and collectively conveys the waste toner discharged from first conveyors 27*k*, 27*c*, 27*m*, and 27*y* to waste toner reclaim container 32. Further, waste toner discharge port 29 connected with a waste toner receiving port (not illustrated) of waste toner reclaim container 32 is provided on a downstream side of second conveyor 28.

Waste toner reclaim container 32 is integrally attached to black toner cartridge 3*k*. In general, since use frequency of the black toner is higher than the other colors, the replacement frequency of black toner cartridge 3*k* is higher as well. With this taken into consideration, black toner cartridge 3*k* and waste toner reclaim container 32 are integrated with each other such that waste toner reclaim container 32 can be replaced, if possible, before waste toner reclaim container 32 becomes full. This configuration is just an example and is not a limited one. Any of toner cartridges 3*c*, 3*m*, and 3*y* and waste toner reclaim container 32 may be integrated with each other. As an alternative, toner cartridges 3*k*, 3*c*, 3*m*, and 3*y* and waste toner reclaim container 32 may be formed separately from each other, and waste toner reclaim container 32 can be detached from development device 2 independently of toner cartridges 3*k*, 3*c*, 3*m*, and 3*y*.

Next, the toner cartridges are described. The following description is focused on toner cartridge 3*y* (hereinafter, referred to as "3") as a representative cartridge, and descriptions of toner cartridges 3*k*, 3*c*, 3*m* are omitted.

Figure 5:
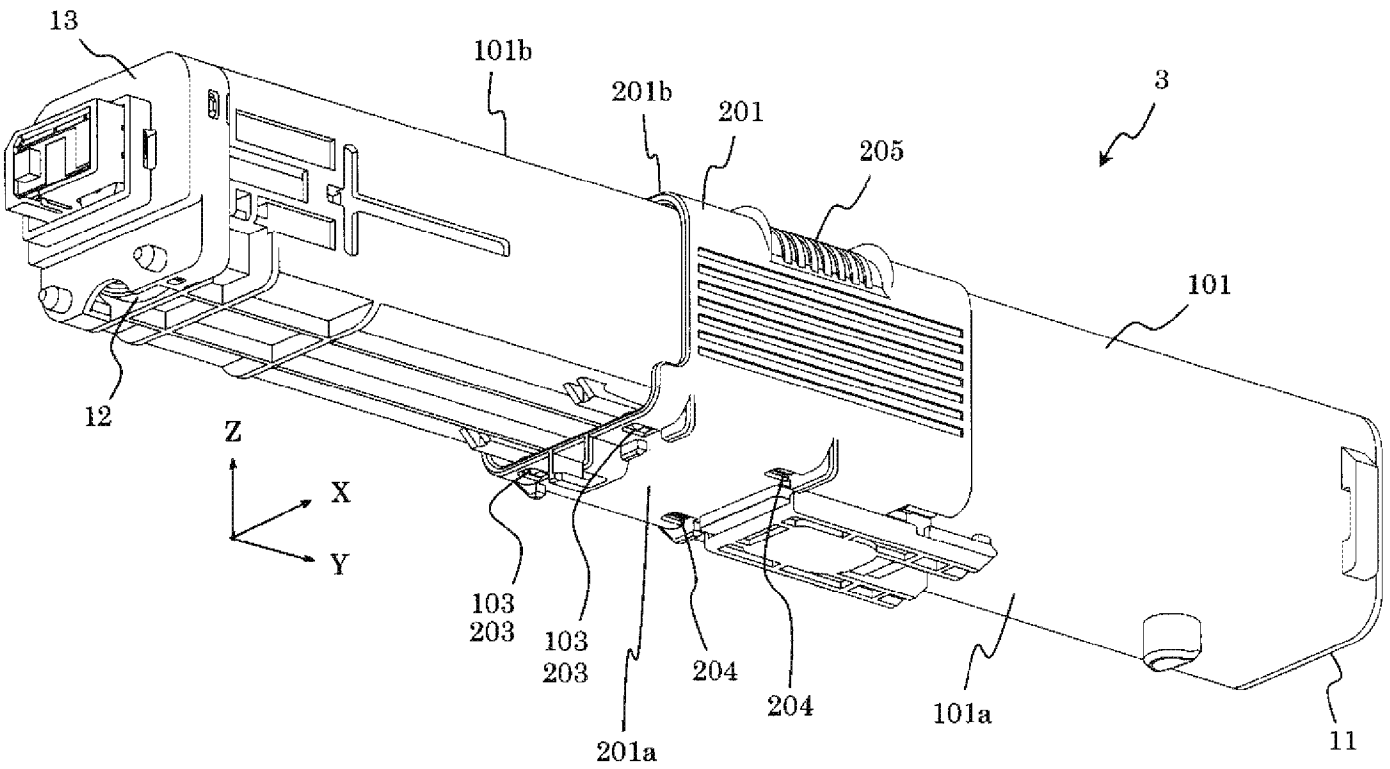
FIG. 5 is an external perspective view illustrating a close position of a shutter member of the toner cartridge according to the first embodiment.
Figure 6:
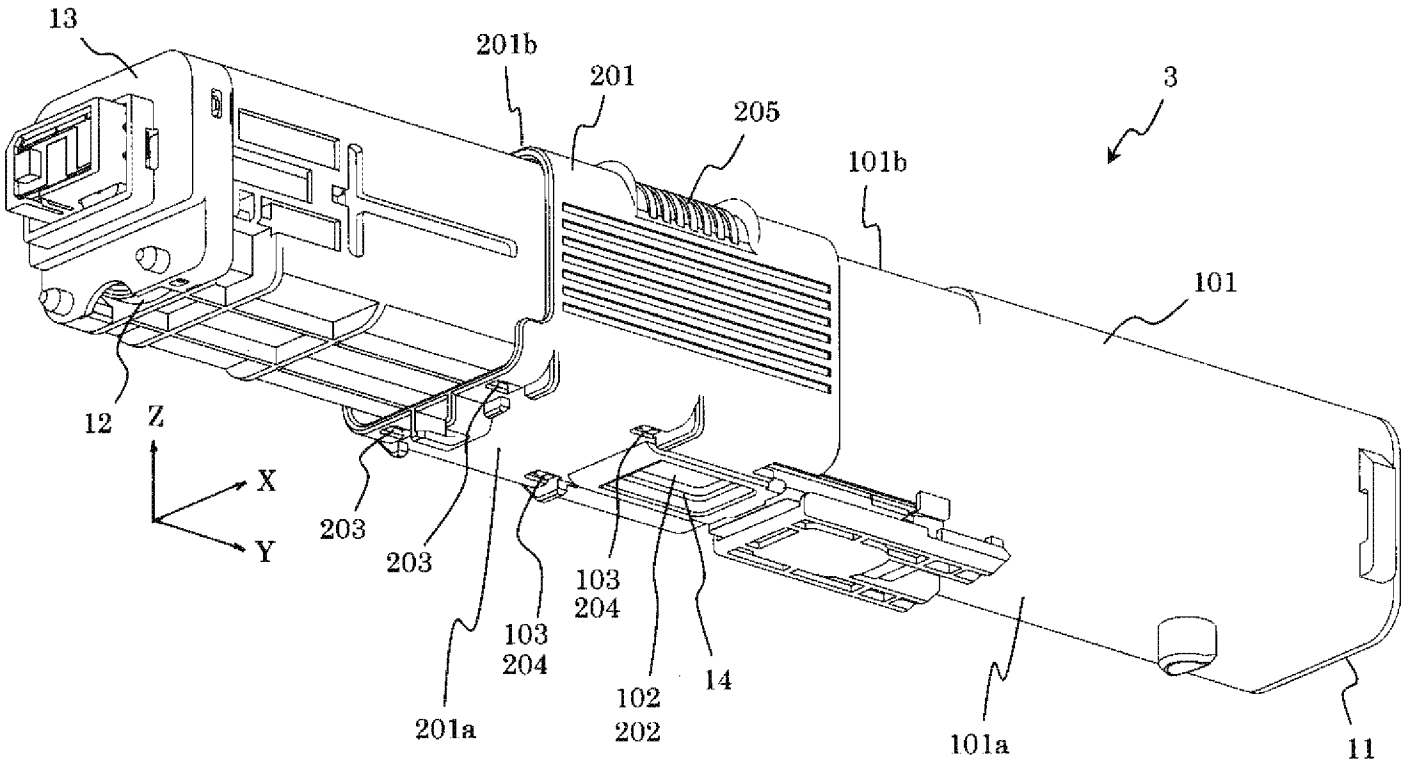
FIG. 6 is an external perspective view illustrating an open position of the shutter member of the toner cartridge according to the first embodiment.
Figure 7:
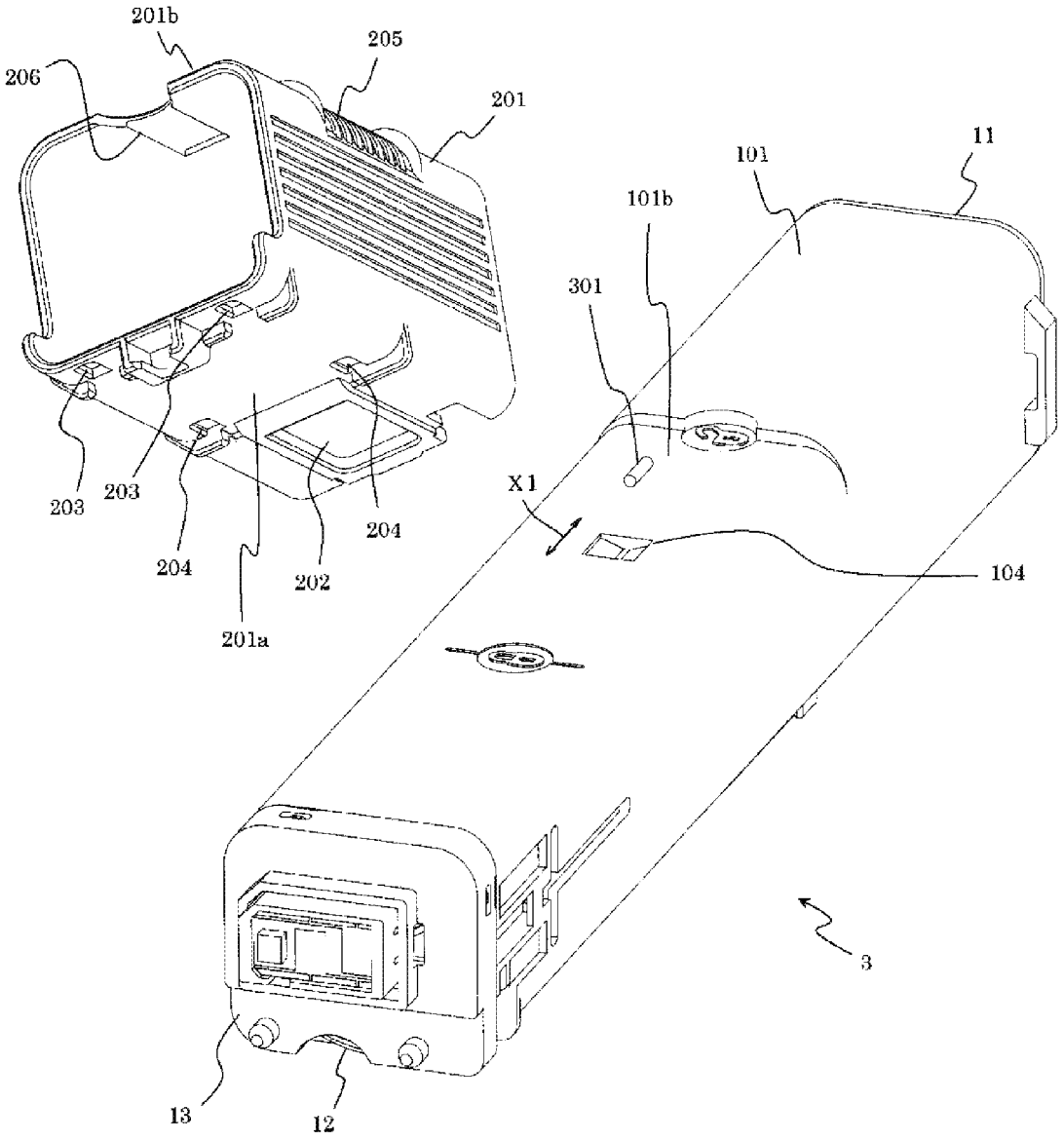
FIG. 7 is an exploded perspective view of the toner cartridge according to the first embodiment.

FIG. 5 is an external perspective view illustrating a close position of the shutter member of the toner cartridge according to the first embodiment. FIG. 6 is an external perspective view illustrating an open position of the shutter member of the toner cartridge according to the first embodiment. FIG. 7 is an exploded perspective view of the toner cartridge according to the first embodiment.

As illustrated in the drawings, toner cartridge 3 includes outer casing 101 as a substantially square-shaped cylindrical developer container body configured to store the toner therein; side plate 11 serving as a lid of outer casing 101; a stirring member (not illustrated) configured to stir and convey the toner in outer casing 101; drive gear 12 configured to fit into an end portion of a rotating shaft of the stirring member and transmit a drive force to the stirring member; side cover 13 for protecting drive gear 12; and substantially square-shaped cylindrical shutter member 201 surrounding outer casing 101 and attached to be movable in a longitudinal direction (Y axis direction) of outer casing 101.

Outer casing 101 has lower surface 101*a* facing development unit 2 and facing downward in the vertical direction (Z axis direction) that is the direction of gravity when outer casing 101 is in the position of use. Lower surface 101*a* is provided with toner supply port 102 as a developer supply port and latch catching claw 103 as a shutter holding element for holding the position of shutter member 201. Shutter member 201 includes lower frame 201*a* configured to close toner supply port 102 and having opening 202 for opening toner supply port 102, first engagement holes 203 and second engagement holes 204. First engagement holes 203 are configured to restrict a movement of shutter member 201 in an open direction (a direction in which shutter member 201 moves to open toner supply port 102) by engaging with latch catching claws 103. Second engagement holes 204 are configured to restrict a movement of shutter member 201 beyond the open position of toner supply port 102 by engaging with latch catching claws 103. Latch catching claws 103 use a snap-fitting function. When toner cartridge 3 is mounted on development unit 2, the tips of latch catching claws 103 are pressed inward and thereby latch catching claws 103 to disengage from first engagement holes 203 so as to allow the shutter member 201 to move in the open direction.

Sealing member 14 is attached onto the outer peripheral surface of toner supply port 102. Sealing member 14 is made of sponge or the like pressed between outer casing 101 and shutter member 201. Sealing member 14 is attached onto the outer peripheral surface of toner supply port 102 by pasting or the like to prevent any leakage of the toner to the outside.

Rough grip surface 205 as a grip part for the operation is formed on upper frame surface 201*b* of shutter member 201 so as to face upward.

When toner cartridge 3 not mounted to development unit 2 is inclined within an angle range where toner supply port 102 turns from a substantially horizontal position to substantially upside in the vertical direction, a movement of shutter member 201 in the open direction may result in a careless opening of toner supply port 102, thereby causing the toner to scatter into the surroundings. For this reason, in this embodiment, a shutter movement restriction unit is provided between outer casing 101 and shutter member 201 to prevent the movement of shutter member 201 in the open direction when toner cartridge 3 is inclined within the range mentioned above.

Next, the shutter movement restriction unit is described. The shutter movement restriction unit includes: first shutter movement restriction groove 104 formed on upper surface 101*b* of outer casing 101; second shutter movement restriction groove 206 formed on upper frame back surface 201*b* of shutter member 201; and pin member 301 as a shutter movement restriction member disposed between first shutter movement restriction groove 104 and second shutter movement restriction groove 206. Note that the shutter movement restriction unit is a feature of this disclosure. Since the shutter movement restriction unit is variously modified with improved components in embodiments described below, the shutter movement restriction unit is described without a reference numeral.

Figure 8:
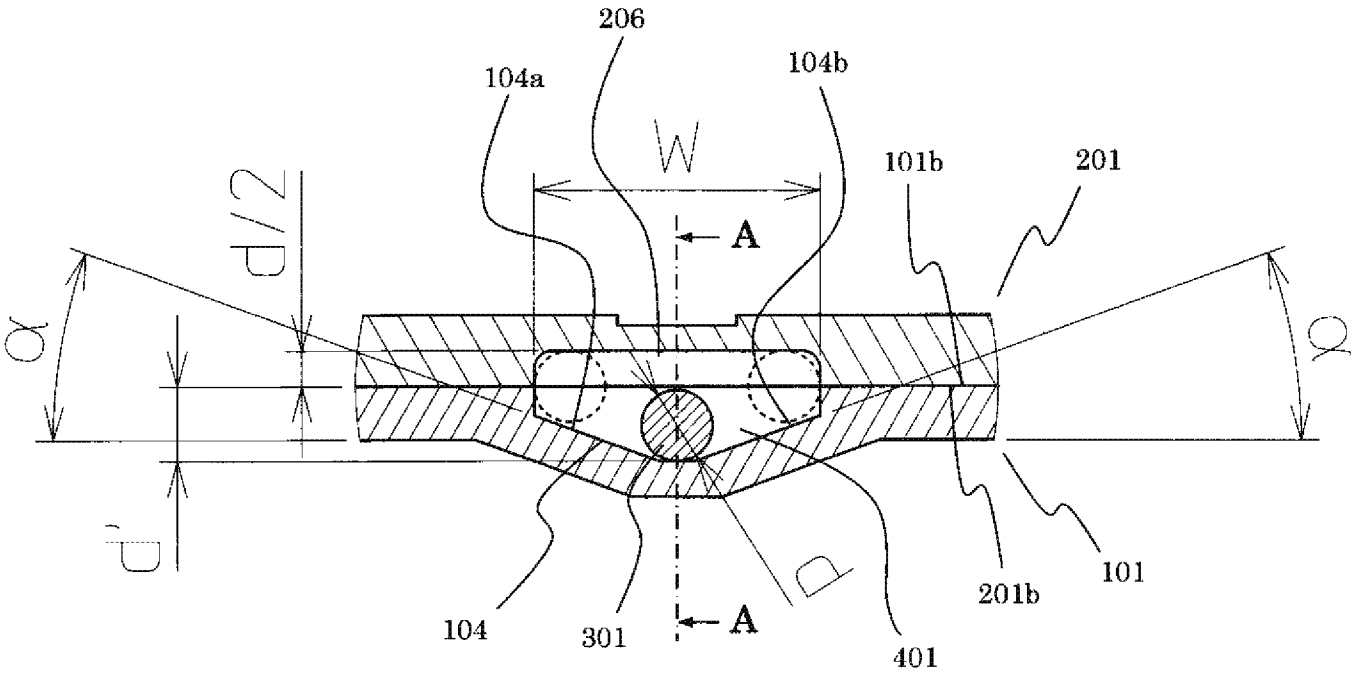
FIG. 8 is a key part enlarged cross sectional view illustrating an enlarged key part of the shutter movement restriction unit according to the first embodiment.
Figure 9:
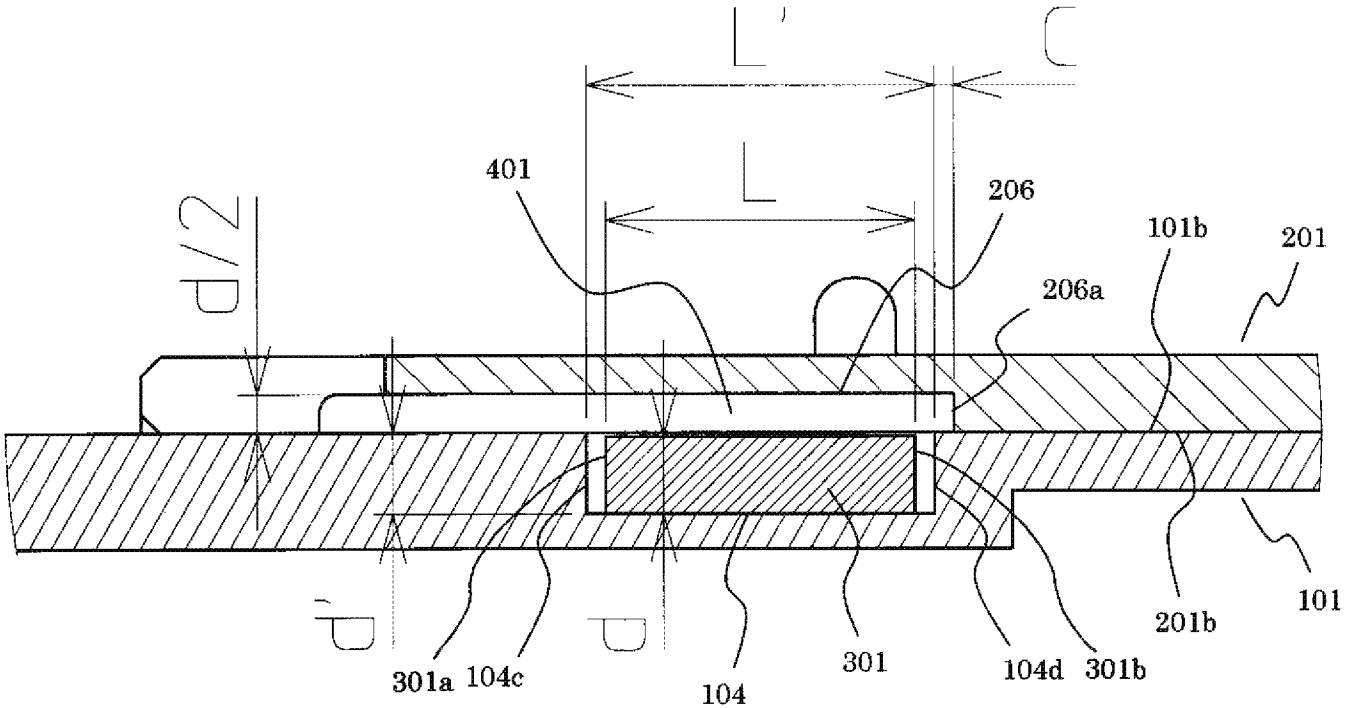
FIG. 9 is a cross sectional view viewed along arrows A-A in FIG. 8.
Figure 10:
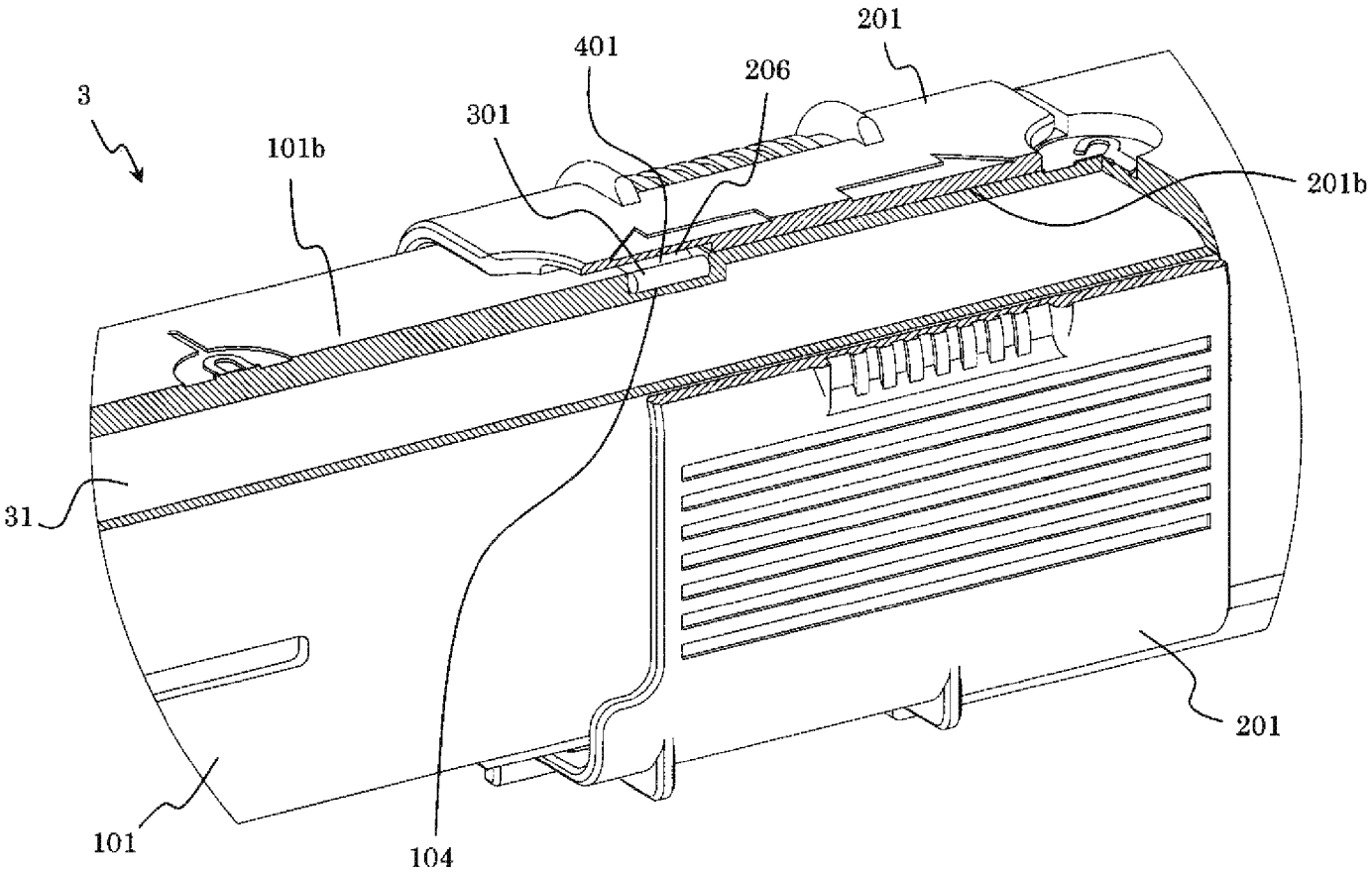
FIG. 10 is a partial cutaway perspective view illustrating the key part of the shutter movement restriction unit according to the first embodiment when the shutter member is closed.
Figure 11:
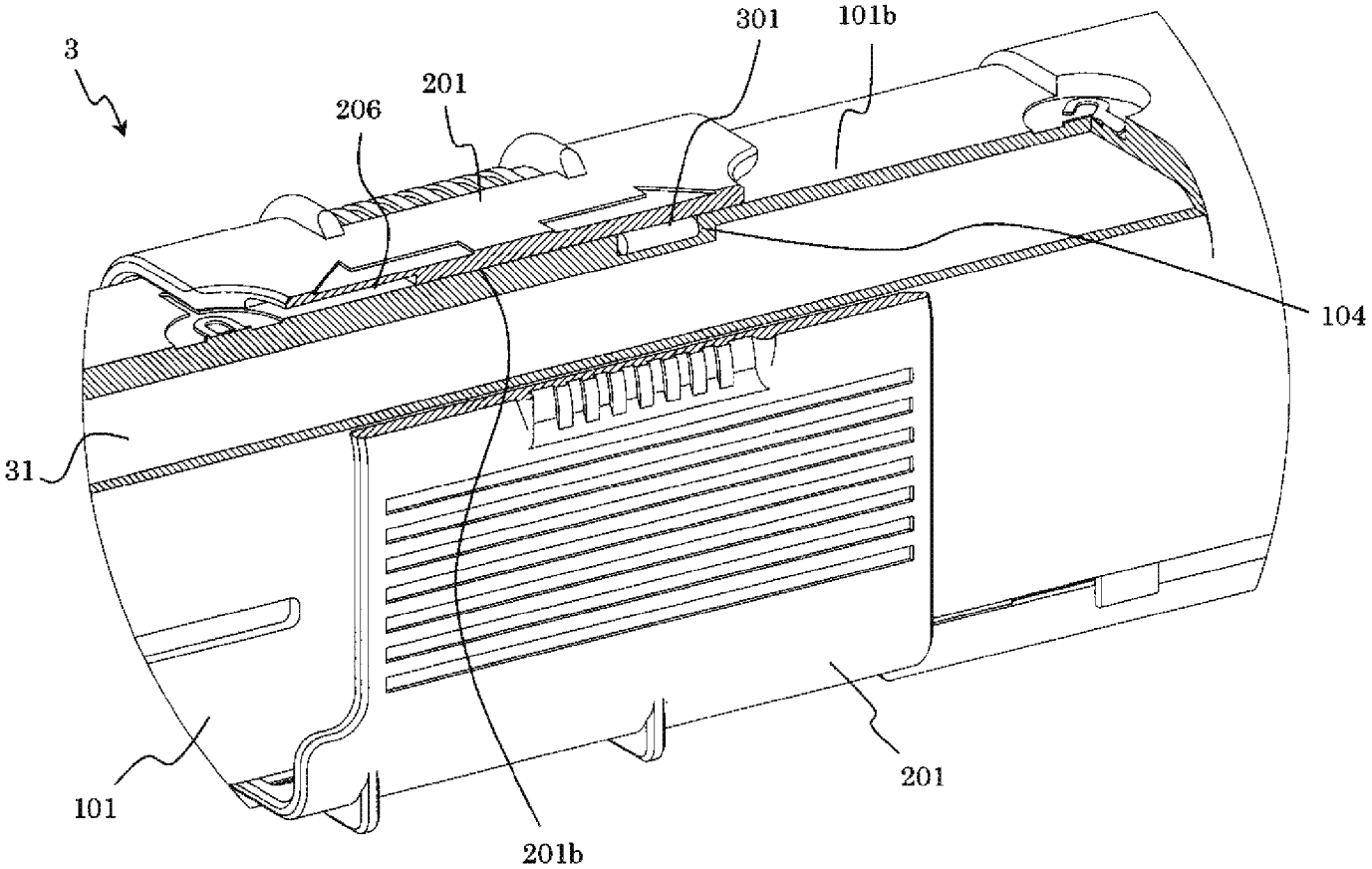
FIG. 11 is a partial cutaway perspective view illustrating the key part of the shutter movement restriction unit according to the first embodiment when the shutter member is opened.

FIG. 1 is a cross sectional view illustrating a key part of the shutter movement restriction unit according to the first embodiment of the invention. FIG. 8 is a key part enlarged cross sectional view illustrating an enlarged key part of the shutter movement restriction unit according to the first embodiment of the invention. FIG. 9 is a cross sectional view viewed along arrows A-A in FIG. 8. FIG. 10 is a partial cutaway perspective view illustrating a key part of the shutter movement restriction unit according to the first embodiment when the shutter member is closed. FIG. 11 is a partial cutaway perspective view illustrating a key part of the shutter movement restriction unit according to the first embodiment when the shutter member is closed. In FIG. 1 and FIGS. 8 to 11, upward and downward directions in the drawings are regarded as vertically upward and downward directions, and the shutter movement restriction unit is illustrated in the position of use in which the toner cartridge is mounted to the development device. In FIG. 8, the front side corresponds to the open direction of shutter member 201. FIG. 9 is the cross sectional view of the shutter movement restriction unit viewed along arrows A-A in FIG. 8.

As illustrated in the drawings, toner cartridge 3 is provided with shutter member 201 surrounding enclose outer casing 101 including toner container 31 therein. That is, outer casing 101 is inserted through the inside of substantially square-shaped cylindrical shutter member 201. Shutter member 201 is pressed downward by sealing member 14 attached to the outer peripheral surface of toner supply port 102 while being pressed between outer casing 101 and shutter member 201. For this reason, upper surface 101*b* of outer casing 101 and upper frame back surface 201*b* of shutter member 201, which are formed substantially in parallel with a horizontal line in the position of use, are always abutted to each other. Substantially V-shaped first shutter movement restriction groove 104 is provided on upper surface 101*b* of outer casing 101. First shutter movement restriction groove 104 includes inclined surfaces 104*a* and 104*b* inclined at an inclination angle $\alpha$ with respect to a horizontal direction (an angle "$90°+\alpha$" with respect to the gravity direction (downward in the Z axis direction)) and extends only by a predetermined length L' in the movement direction of shutter member 201.

First shutter movement restriction groove 104 is provided with a restriction direction parallel with the movement direction of shutter member 201. The restriction direction is the direction in which first shutter movement restriction groove 104 restricts the movement of pin member 301 as a shutter movement restriction member. Specifically, the restriction direction is the arrow X1 direction in FIG. 7. First shutter movement restriction groove 104 is a groove having a cross sectional shape in which a certain portion is recessed deeply and is connected to an edge (or edges) via an inclined surface (or inclined surfaces). Here, first shutter movement restriction groove 104 has a cross sectional shape in which the deepest portion at a center side is recessed deeper than the shallowest portions at edges of both sides. Inclined surfaces extend from the deepest portion to the shallowest portions on both sides. Specifically, the cross sectional shape is formed into a V shape with the center portion recessed deeper than both the sides. In this way, the cross sectional shape is formed with the center portion recessed deeper than both the sides. Cylindrical pin member 301 having a diameter d is disposed between restriction direction end faces 104*c* and 104*d* of first shutter movement restriction groove 104. The substantially V-shape center portion of first shutter movement restriction groove 104 is formed with a depth d' that is not less than the diameter d of cylindrical pin member 301. With such a configuration, when first shutter movement restriction groove 104 is held horizontal (when toner cartridge 3 is in use), pin member 301 rolls down along any of inclined surfaces 104*a* and 104*b* to the substantially V-shape center portion due to gravity.

Second shutter movement restriction groove 206 is provided in a portion of upper frame back surface 201*b* of shutter member 201. The portion faces first shutter movement restriction groove 104 when shutter member 201 is in the close position (the position illustrated in FIG. 5). Second shutter movement restriction groove 104 has a depth d/2 and a width equivalent to the width of first shutter movement restriction groove 104. Depth d/2 is set to be the most preferable depth such that end face 301*a* of pin member 301 abuts to restriction direction end face 104*c* of first shutter movement restriction groove 104 in a reliable manner so as to serve as a prop for restricting the movement of shutter member 201. Therefore, the depth is not limited to d/2, and may be a depth enough for pin member 301 to serve as the prop. This also applies to other embodiments.

Further, restriction direction end face 206*a* (a right end face in FIG. 9), at an upstream side in the open direction of second shutter movement restriction groove 206 extending in a movement direction of shutter member 201, is positioned outside by predetermined clearance C from restriction direction end face 104*d* (a right end face in FIG. 9) of first shutter movement restriction groove 104. In this way, first shutter movement restriction groove 104 and second shutter movement restriction groove 206 are joined together to form a space of guide path 401. Pin member 301 is put inside guide path 401. With this configuration, pin member 301 can freely shift along the inner periphery of guide path 401 as illustrated by the broken lines and the solid lines in FIG. 8. As illustrated in FIGS. 10 and 11, first shutter movement restriction groove 104 is provided in an area where first shutter movement restriction groove 104 is covered with shutter member 201 and is not externally exposed from shutter member 201, all the time when shutter member 201 moves from the close position (the position illustrated in FIG. 5) to the open position (the position illustrated in FIG. 6).

For example, according to this embodiment, pin member 301 is set with a diameter d=2 m and a length L=8 mm. First shutter movement restriction groove 104 is set with inclination angle $\alpha=20°$, width W=8 mm, depth d'=2.2 mm, and extension length L'=8.5 mm. Second shutter movement restriction groove 206 is set with width W=8 mm, depth d/2=1 mm, and clearance C=0.5 mm.

Next, the operation of electrophotographic printer 1 having the above configuration is described. Since overall operation of electrophotographic printer 1 is the same as conventional electrophotographic printers, description is made hereinafter by focusing on operations of the shutter movement restriction unit.

Figure 12:
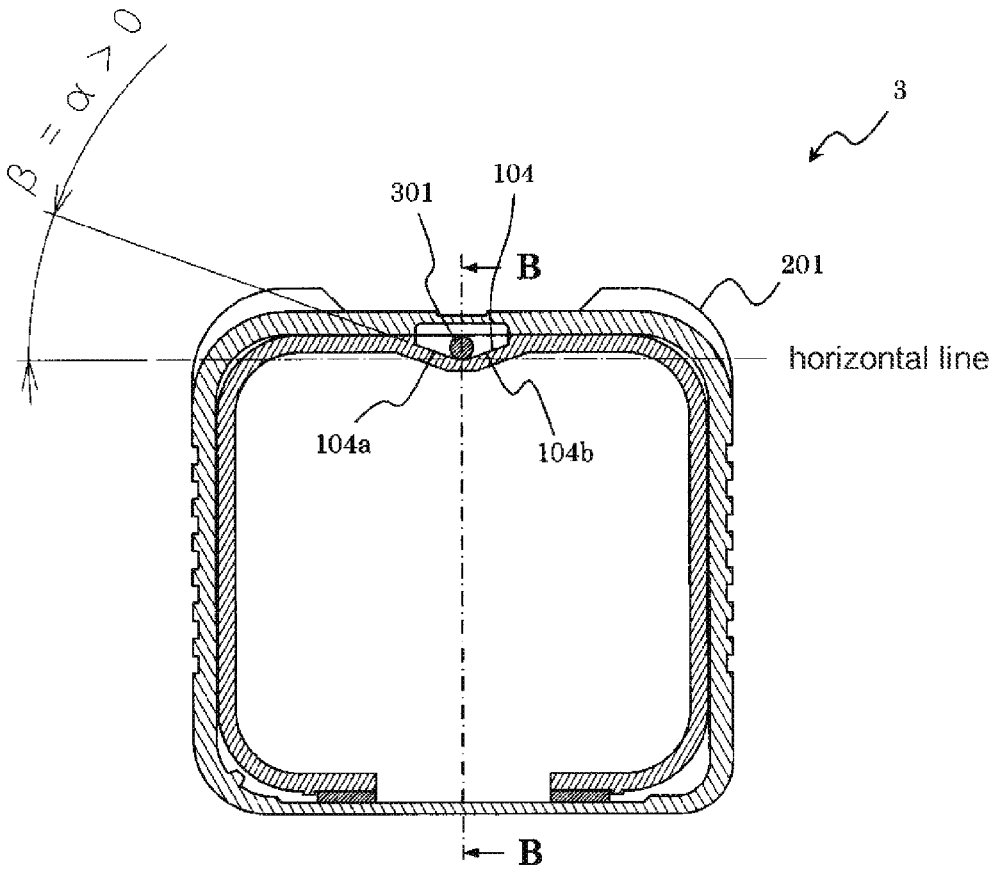
FIG. 12 is a cross sectional view illustrating the shutter movement restriction unit in a horizontal position according to the first embodiment when the toner cartridge is in a position of use.
Figure 13:
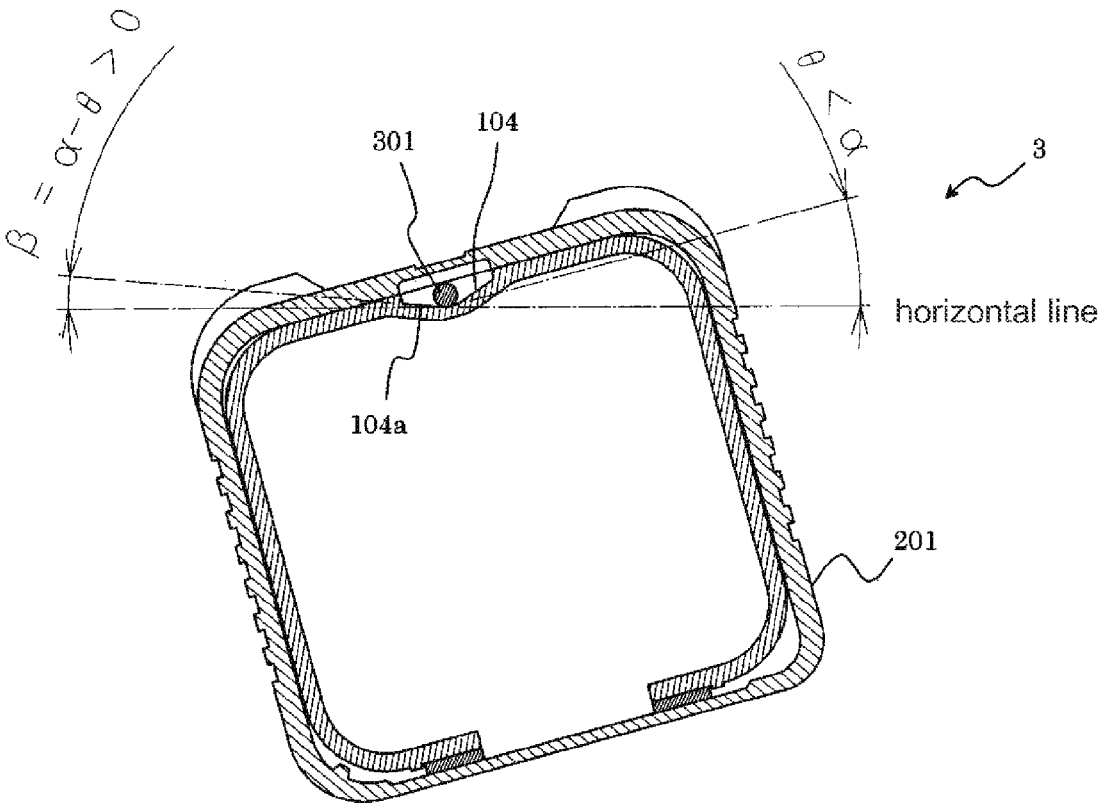
FIG. 13 is a cross sectional view illustrating the toner cartridge inclined at an angle $\theta$ ($\theta<\alpha$) from the horizontal position according to the first embodiment.
Figure 14:
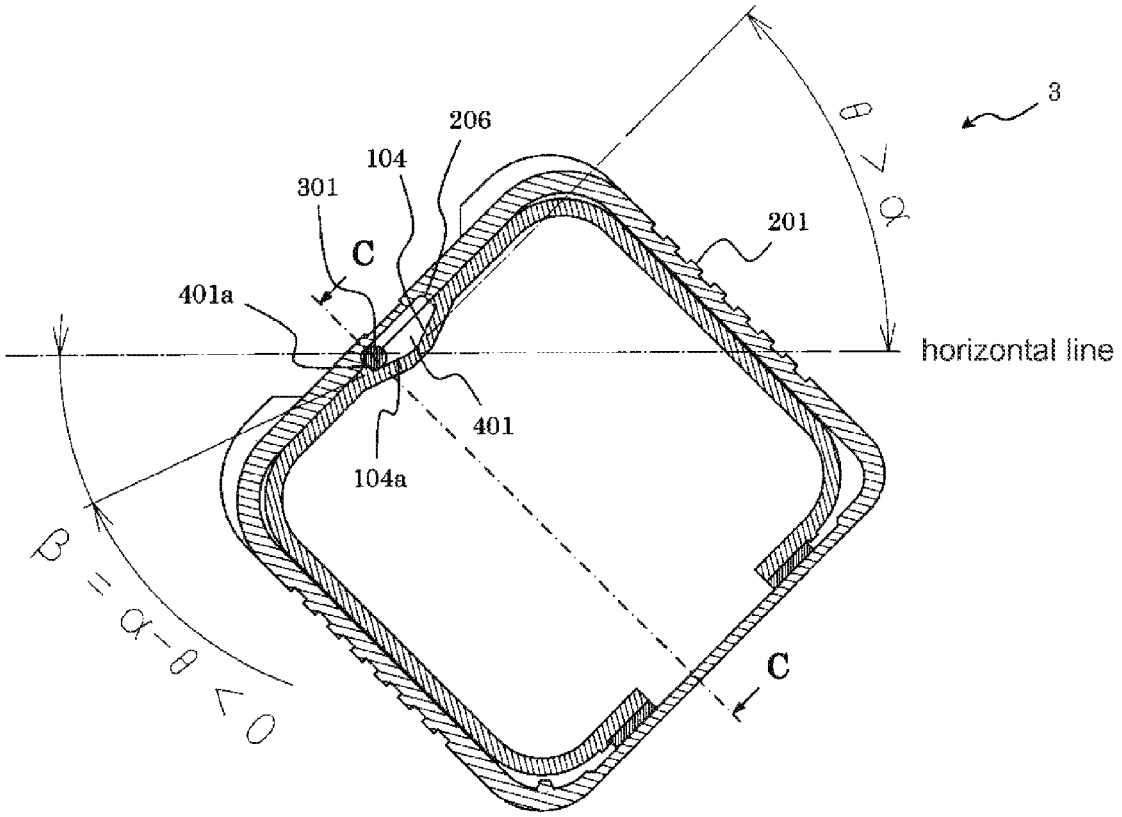
FIG. 14 is a cross sectional view illustrating the toner cartridge inclined at an angle $\theta$ ($\theta>\alpha$) from the horizontal position according to the first embodiment.
Figure 15:
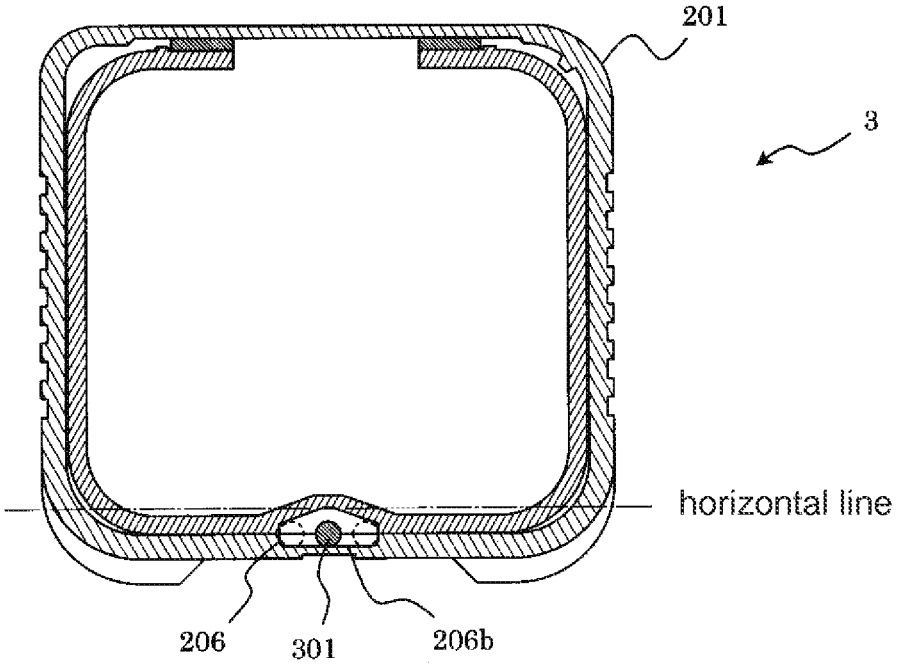
FIG. 15 is a cross sectional view illustrating the toner cartridge rotated by 180° from the horizontal position according to the first embodiment.
Figure 16:
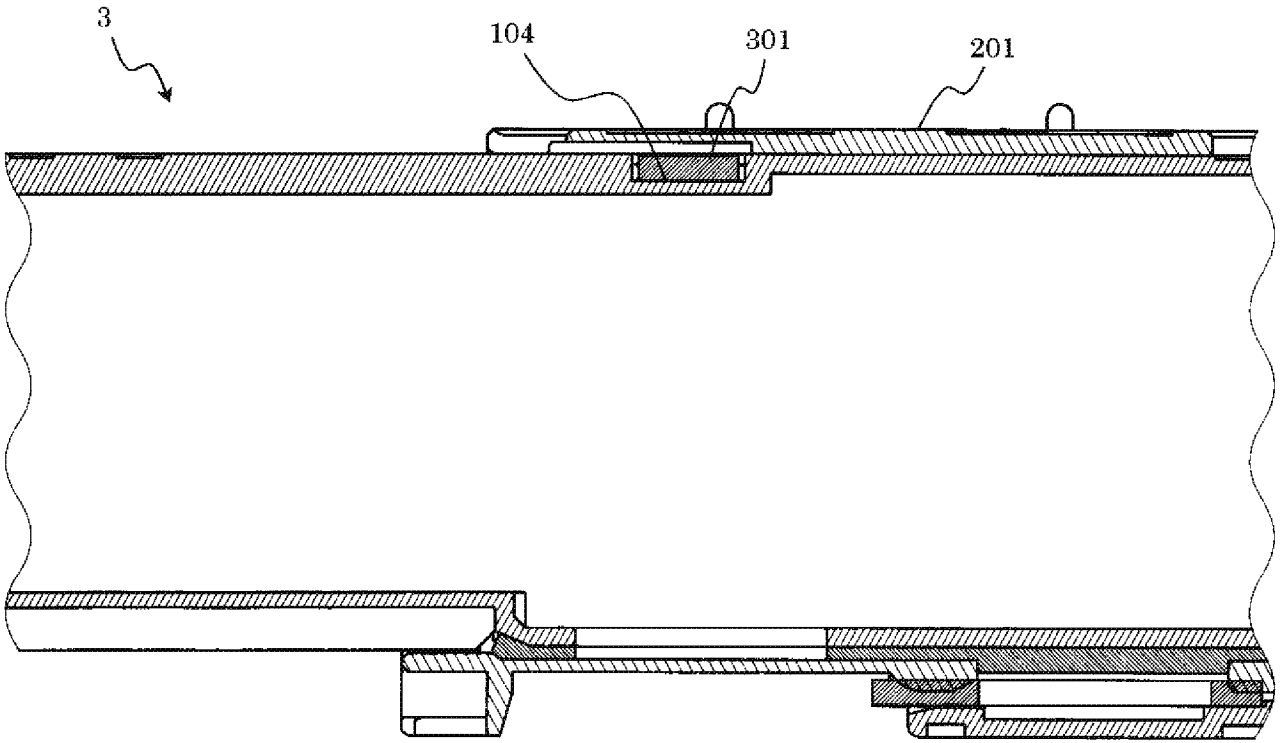
FIG. 16 is a cross sectional view viewed along arrows B-B in FIG. 12, illustrating an opening operation of the shutter movement restriction unit with the shutter element at a close position according to the first embodiment.
Figure 17:
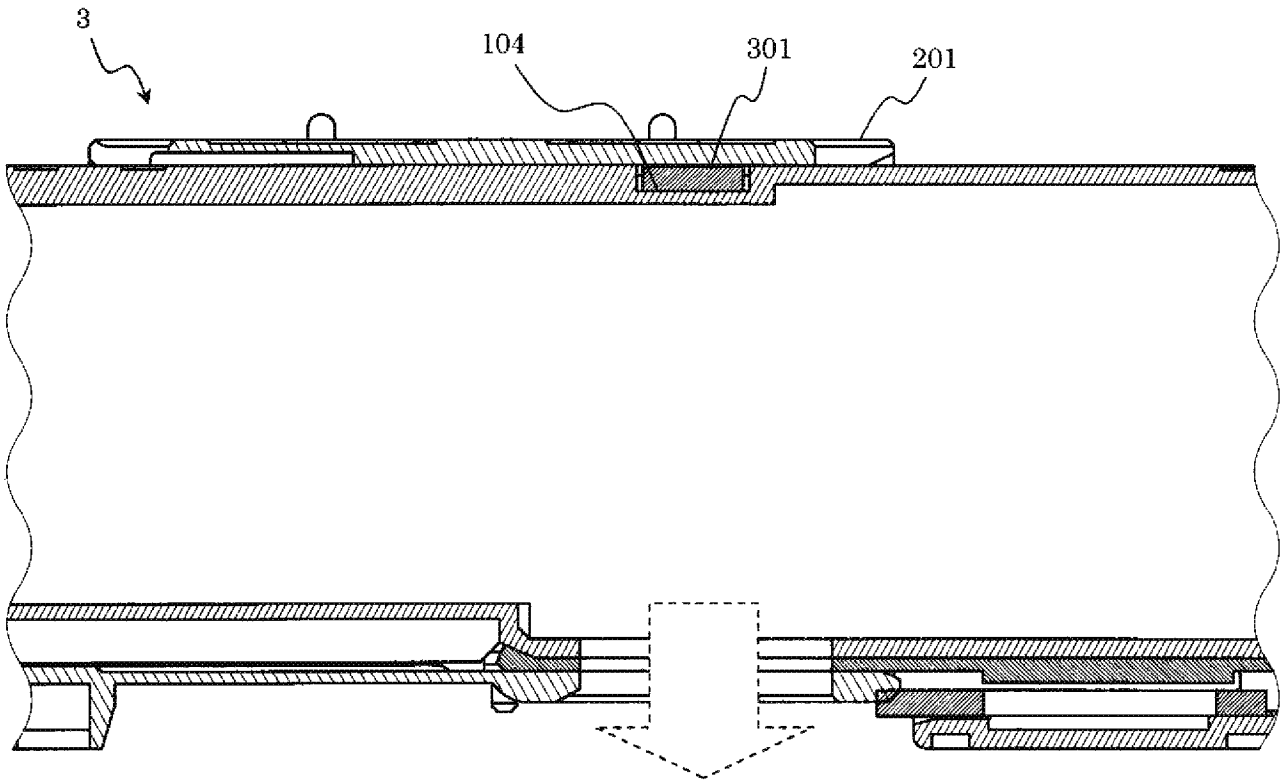
FIG. 17 is a cross sectional view viewed along arrows B-B in FIG. 12, illustrating the opening operation of the shutter movement restriction unit with the shutter element moved in an open direction according to the first embodiment.
Figure 18:
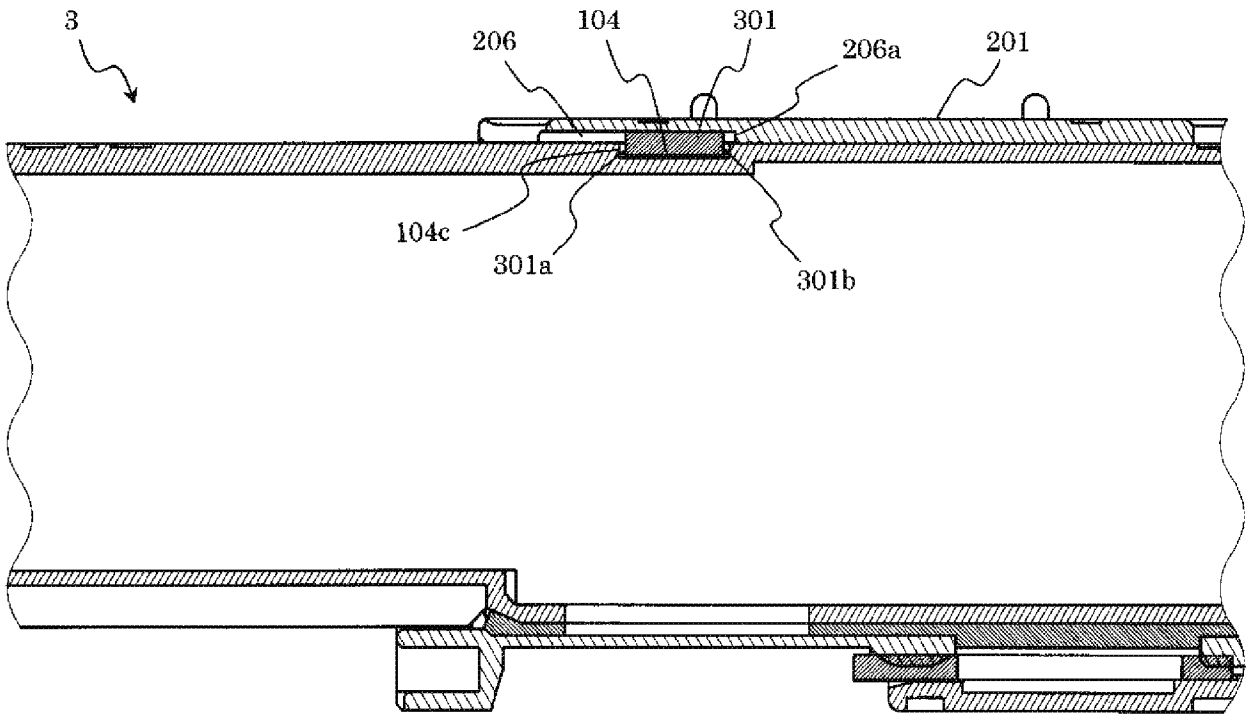
FIG. 18 is a cross sectional view viewed along arrows C-C in FIG. 14, illustrating the opening operation of the shutter movement restriction unit with the shutter element at the close position according to the first embodiment.
Figure 19:
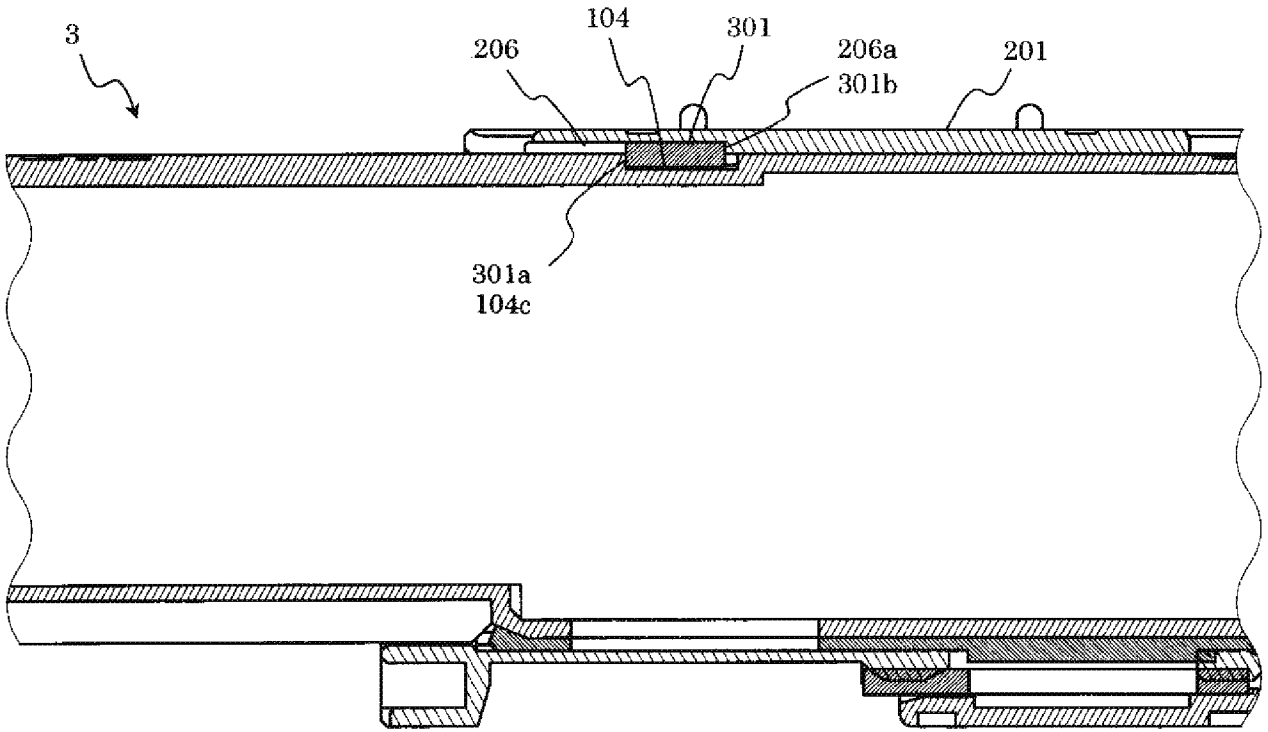
FIG. 19 is a cross sectional view viewed along arrows C-C in FIG. 14, illustrating the opening operation of the shutter movement restriction unit where the shutter element is about to be moved in the open direction according to the first embodiment.

FIG. 12 is a cross sectional view illustrating toner cartridge 3 according to the first embodiment when the shutter movement restriction unit is in a horizontal position, which is the position of use. FIG. 13 is a cross sectional view illustrating toner cartridge 3 according to the first embodiment inclined at an angle $\theta$ ($\theta<\alpha$) from a horizontal position. FIG. 14 is a cross sectional view illustrating toner cartridge 3 according to the first embodiment inclined at an angle $\theta$ ($\theta>\alpha$) from the horizontal position. FIG. 15 is a cross sectional view illustrating toner cartridge 3 according to the first embodiment rotated by 180° from the horizontal position. FIG. 16 is a cross sectional view viewed along arrows B-B in FIG. 12, illustrating an opening operation of the shutter movement restriction unit according to the first embodiment. FIG. 17 is a cross sectional view viewed along arrows B-B in FIG. 12, illustrating an opening operation of the shutter movement restriction unit according to the first embodiment. FIG. 18 is a cross sectional view viewed along arrows C-C in FIG. 14, illustrating an opening operation of the shutter movement restriction unit according to the first embodiment. FIG. 19 is a cross sectional view viewed along arrows C-C in FIG. 14, illustrating an opening operation of the shutter movement restriction unit according to the first embodiment.

In FIGS. 12 to 15, the front side in the drawings corresponds to the open direction of shutter member 201, and toner cartridge 3 is inclined (rotated) with respect to a longitudinal direction axis counterclockwise. FIGS. 16 and 17 are the cross sectional views of toner cartridge 3 viewed along arrows B-B in FIG. 12, and FIG. 16 illustrates shutter member 201 at the close position. FIG. 17 illustrates shutter member 201 moved in the open direction. FIGS. 18 and 19 are the cross sectional views of toner cartridge 3 viewed along arrows C-C in FIG. 14, and FIG. 18 illustrates shutter member 201 at the close position. FIG. 19 illustrates shutter member 201 being about to be moved in the open direction.

As illustrated in FIG. 12 and FIGS. 16 and 17, when toner cartridge 3 is at the position of use, pin member 301 stays at a substantially center portion of first shutter movement restriction groove 104. That is, when an inclination angle $\beta$ of inclined surface 104*a* with respect to a horizontal line is the same as an inclination angle $\alpha$, the substantially V-shape center portion in inclined surfaces 104*a* and 104*b* is located at the lowest position in the vertical direction (Z axis direction). Thus, pin member 301 stays at the substantially V-shape center portion of first shutter movement restriction groove 104 due to a gravitational action.

In this state, entire pin member 301 stays inside first shutter movement restriction groove 104. This prevents pin member 301 from coming into contact with restriction direction end face 206*a* of second shutter movement restriction groove 206. As a result, shutter member 201 is movable in the open direction without being restricted by pin member 301.

As illustrated in FIG. 13, when the inclination angle $\theta$ of toner cartridge 3 is smaller than the inclination angle $\alpha$ ($\theta<\alpha$), the inclination angle $\beta$ formed by inclination surface 104*a* with respect to the horizontal line is $\beta=\alpha-\theta>0$. Therefore, pin member 301 still remains at the substantially V-shape center portion of first shutter movement restriction groove 104.

Thus, in the states illustrated in FIGS. 12 and 13, shutter member 201 can be moved from the close position to the open position as illustrated in FIG. 17.

In contrast, as illustrated in FIGS. 14, 18 and 19, when the inclination angle $\theta$ of toner cartridge 3 is larger than the inclination angle $\alpha$ ($\theta>\alpha$), the inclination angle $\beta$ formed by inclined surface 104*a* with respect to the horizontal line is $\beta=\alpha-\theta<0$. That is, inclination surface 104*a* in inclined downward to the edge of shutter movement restriction groove 104. As a result, pin member 301 shifts by rolling on inclined surface 104*a* due to a gravitational action, and rests by abutting to side 401*a* of guide path 401.

As a result, pin member 301 is located in both first shutter movement restriction groove 104 and second shutter movement restriction groove 206, and a semicircular portion of pin member 301 protrudes in a region of second shutter movement restriction groove 206. Thereby, in FIG. 19, when shutter member 201 is moved in the open direction, restriction direction end face 206*a* of second shutter movement restriction groove 206 hits end face 301*b* of pin member 301. Other end face 301*a* of pin member 301 abuts to restriction direction end face 104*c* of first shutter movement restriction groove 104, and thereby pin member 301 serves as a prop for restricting the movement of shutter member 201. This prevents a further movement of shutter member 201. In such a manner, the movement of pin member 301 restricts the movement of shutter member 201 in the open direction.

As illustrated in FIG. 15, when toner cartridge 3 is rotated by 180°, pin member 301 is positioned on bottom surface 206*b* of second shutter movement restriction groove 206. In this state, even if pin member 301 moves to any position on bottom surface 206*b*, the semicircular portion thereof protrudes into the region of first shutter movement restriction groove 104. Thereby, the movement of shutter member 201 in the open direction is restricted as similar to the state illustrated in FIG. 14.

In this way, in the case where toner cartridge 3 is inclined clockwise or counterclockwise from the position of use, shutter member 201 can be moved in the open direction only when the inclination angle is within a range of $\beta<\alpha$. That is, only when the inclination angle is within the range of $\beta<\alpha$, the shutter movement restriction is released and thereby shutter member 201 can be opened. When toner cartridge 3 is further inclined, the shutter movement restriction functions to prevent the opening of shutter member 201.

The inclination angle of toner cartridge 3 for causing the shutter movement restriction to function is adjusted by varying the inclination angle $\alpha$ of inclined surfaces 104*a* and 104*b*. More specifically, the setting of a small inclination angle $\alpha$ enables the shutter movement restriction to function even when toner cartridge 3 is inclined slightly. In contrast, the setting of a large inclination angle $\alpha$ enables the shutter movement restriction to function when toner cartridge 3 is inclined to a great extent. Preferably, the inclination angle is set to 10° to 80°, both inclusive.

As described above, according to the first embodiment, guide path 401 formed by first shutter movement restriction groove 104 of outer casing 101 and second shutter movement restriction groove 206 of shutter member 201 is provided to store the shutter movement restriction member (pin member 301) configured to change its position due to a gravitational action. Guide path 401 is formed into a substantially V shape having an obtuse angle facing downward in the vertical direction when toner cartridge 3 is in the position of use.

In this way, even when toner cartridge 3 stays in the middle of rotating by 180° from the position of use, or when the developer supply port disposed downside in the vertical direction in the position of use is inclined within an angle range where the developer supply port turns from a substantially horizontal direction to substantially upside in the vertical direction, the shutter movement restriction member (pin member 301) shifts in guide path 401 due to a gravitational action to a position where the movement of shutter member 201 is restricted. Thus, since the movement of shutter member 201 in the open direction is blocked, the careless operation is reliably prevented from opening the toner supply port and thereby from scattering the toner into the surroundings. Further, entry of any foreign matter into the inside can be prevented.

In this way, even when toner cartridge 3 is inclined oblique to a position of the normal setting, the shutter movement restriction member (pin member 301) shifts in guide path 401 due to a gravitational action and thereby restricts the movement of shutter member 201. As far as the movement of the shutter member 201 is restricted, a careless operation is prevented from opening the toner supply port and thereby from scattering the toner into the surroundings. That is, even when the operator is going to move shutter member 201 carelessly, the shutter movement restriction unit blocks the operation. Thus, even when the operator performs a careless operation, the scattering of the toner due to the opening of the toner supply port does not occur. Thus, the reliability of toner cartridge 3 can be enhanced.

Second Embodiment

Figure 20:
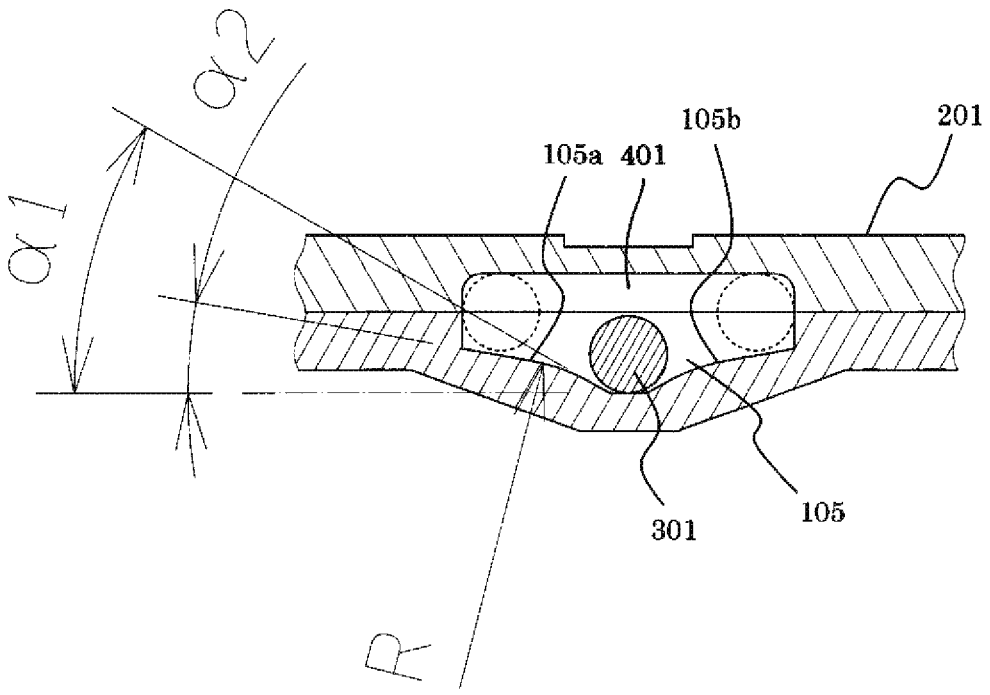
FIG. 20 is a key part cross sectional view illustrating a shutter movement restriction unit according to a second embodiment of the invention.

Next, a second embodiment is described. This embodiment is characterized by improved inclined surfaces 104*a* and 104*b* of first shutter movement restriction groove 104. FIG. 20 is a key part cross sectional view illustrating a shutter movement restriction unit according to the second embodiment.

As illustrated in FIG. 20, inclined surfaces 105*a* and 105*b* of first shutter movement restriction groove 105 according to this embodiment have a larger inclination angle at a center portion thereof to cause the shutter movement restriction function to operate sharply. Specifically, inclined surfaces 105*a* and 105*b* of first shutter movement restriction groove 105 are curved. When an inclination angle of a substantially V-shape center portion of inclined surfaces 105*a* and 105*b* is $\alpha 1$ and an inclination angle of a side portion thereof is $\alpha 2$, inclined surfaces 105*a* and 105*b* are set to $\alpha 1 > \alpha 2$. Inclined surfaces 105*a* and 105*b* as a whole are formed to be a curved surface of curvature R.

Further, a substantially V-shape center portion of inclined surfaces 105*a* and 105*b* is formed into a shape in which pin member 301 can be caught. Pin member 301 stays in the V-shape center portion of inclined surfaces 105*a* and 105*b* until toner cartridge 3 is inclined at a preset angle where the shutter movement restriction function activates. When toner cartridge 3 is inclined beyond the preset angle, pin member 301 moves as illustrated by a dotted line in FIG. 20 and thereby the shutter movement restriction function activates.

With such a configuration, the same effects as those of the first embodiment can be obtained. Additionally, a steadier shift motion can be achieved because pin member 301 does not stay halfway on any of inclined surfaces 105*a* and 105*b* even when toner cartridge 3 is inclined at substantially the same angle as the inclination angle $\alpha 1$.

Third Embodiment

Figure 21:
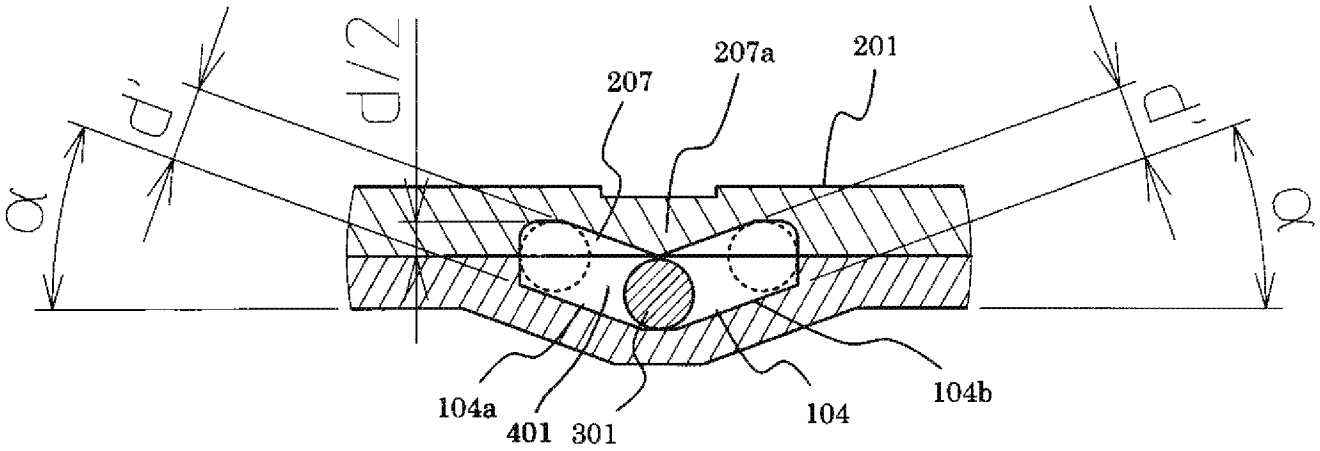
FIG. 21 is a key part cross sectional view illustrating a shutter movement restriction unit according to a third embodiment of the invention.

Next, a third embodiment is described. This embodiment is characterized by a chevron-shaped rib provided to guide path 401. FIG. 21 is a key part cross sectional view illustrating a shutter movement restriction unit according to the third embodiment.

In this embodiment, chevron-shaped rib 207*a* inclined from a center portion to both sides in the width direction of second shutter movement restriction groove 207 is provided as illustrated in FIG. 21. Chevron-shaped rib 207*a* is a guide rib configured to guide pin member 301 without having a play in the width direction of second shutter movement restriction groove 207. Chevron-shaped rib 207*a* is formed into a chevron shape protruding downward from the shallowest portions on both sides to the deepest portion at a central side of first shutter movement restriction groove 104. In this configuration, the height of the rib apex can be set to not more than d/2 of second shutter movement restriction groove 207. The inclination angle can be set such that minimum distance d' between chevron-shaped rib 207*a* and inclined surfaces 104*a* and 104*b* of first shutter movement restriction groove 104 can be not less than d. With these settings, guide path 401 is formed into a V shape, and thereby pin member 301 can move along the V shape.

With such a configuration, the same actions and effects as those of the first embodiment can be obtained. Even when toner cartridge 3 is rotated by 180° from the position of use, the position of pin member 301 is held without having a play in the width direction of second shutter movement restriction groove 207. Thereby, pin member 301 is prevented from becoming off-balance, and a steadier shift motion can be achieved.

Fourth Embodiment

Figure 22:
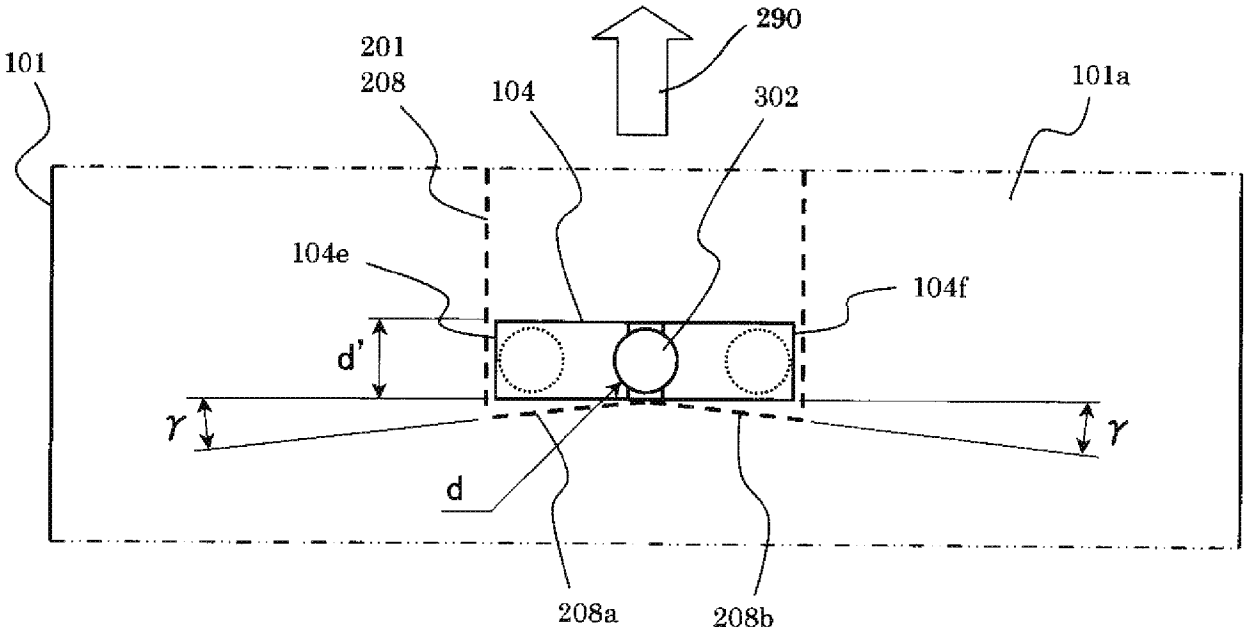
FIG. 22 is a partial plan view illustrating a shutter movement restriction unit according to a fourth embodiment of the invention.

Next, a fourth embodiment is described. This embodiment is characterized by a spherically-shaped shutter movement restriction member. FIG. 22 is a partial plan view illustrating a shutter movement restriction unit according to the fourth embodiment.

Instead of a cylindrical member, spherical member 302 having a spherical diameter d is used as the shutter movement restriction member according to this embodiment. The extension length of first shutter movement restriction groove 104 is set, for example, to d'. Second shutter movement restriction groove 208 of shutter member 201 located to face first shutter movement restriction groove 104 is indicated by a broken line. Second shutter movement restriction groove 208 includes restriction direction end faces 208*a* and 208*b* in which a center portion protrudes in the open direction being a direction of arrow 290, and both sides of the center portion incline at an inclination angle $\gamma$. With this configuration, a steadier shift motion can be achieved by using spherical member 302 as the shutter movement restriction member.

Since restriction direction end faces 208*a* and 208*b* of second shutter movement restriction groove 208 crossing a sliding direction of the shutter have the inclination angle $\gamma$, a force occurs pushing spherical member 302 into side 104*e* or 104*f* of first shutter movement restriction groove 104. That is, when shutter member 201 tries to move in the open direction with spherical member 302 offset to side 104*e* or 104*f* of first shutter movement restriction groove 104, restriction direction end face 208*a* or 208*b* applies a force pushing spherical member 302 into side 104*e* or 104*f* of first shutter movement restriction groove 104. Thus, spherical member 302 is prevented from fleeing toward the center portion of first shutter movement restriction groove 104, and thereby spherical member 302 can be shifted more steadily.

Figure 23:
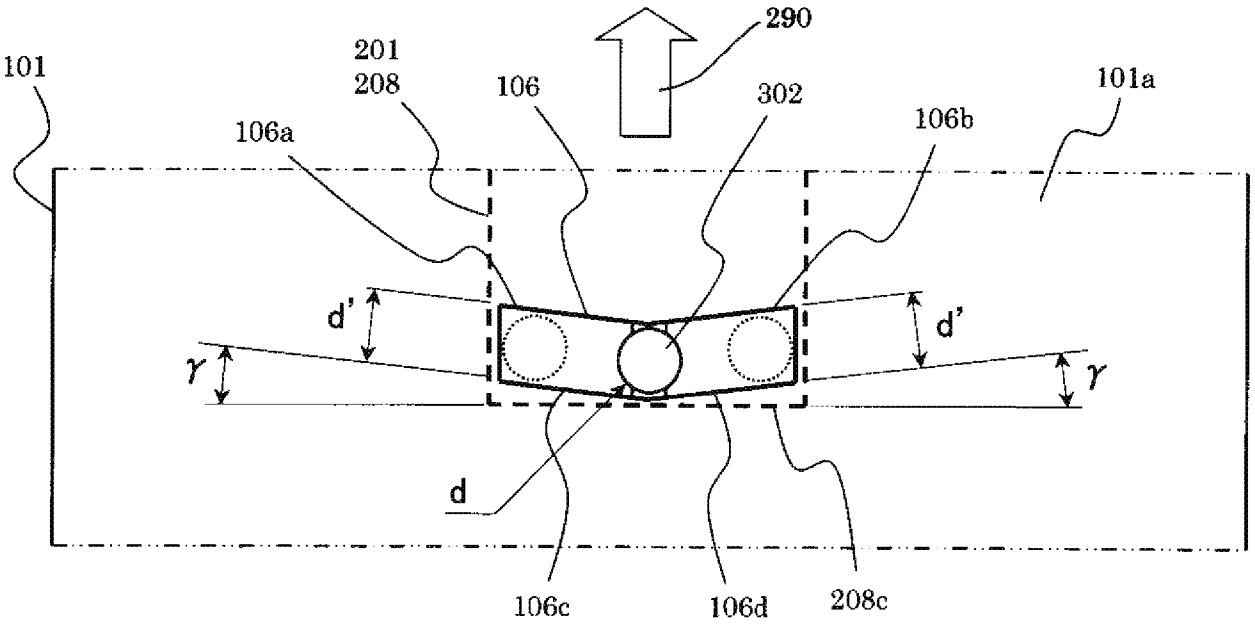
FIG. 23 is a partial plan view illustrating a modified example of the shutter movement restriction unit according to the fourth embodiment.

The inclination angle $\gamma$ may be provided to first shutter movement restriction groove 104. As illustrated in FIG. 23, first shutter movement restriction groove 104 may be provided with restriction direction end faces 106*a*, 106*b*, 106*c*, and 106*d* formed at the inclination angle $\gamma$ on both sides of a center portion concaved in the open direction, being the direction of arrow 290, while restriction direction end face 208*c* of second shutter movement restriction groove 208 is made straight. In this case, the same actions and effects as those described above can be also obtained. Further, the inclination angle $\gamma$ may be provided to both of first shutter movement restriction groove 104 and second shutter movement restriction groove 208.

Fifth Embodiment

Next, a fifth embodiment is described. Here, constituents having the same configuration as those in the first embodiment are designated by the same reference numerals, and duplicate description thereof is omitted. The effects of the invention having the same configuration are incorporated by referring to the effects of the first embodiment.

Figure 24:
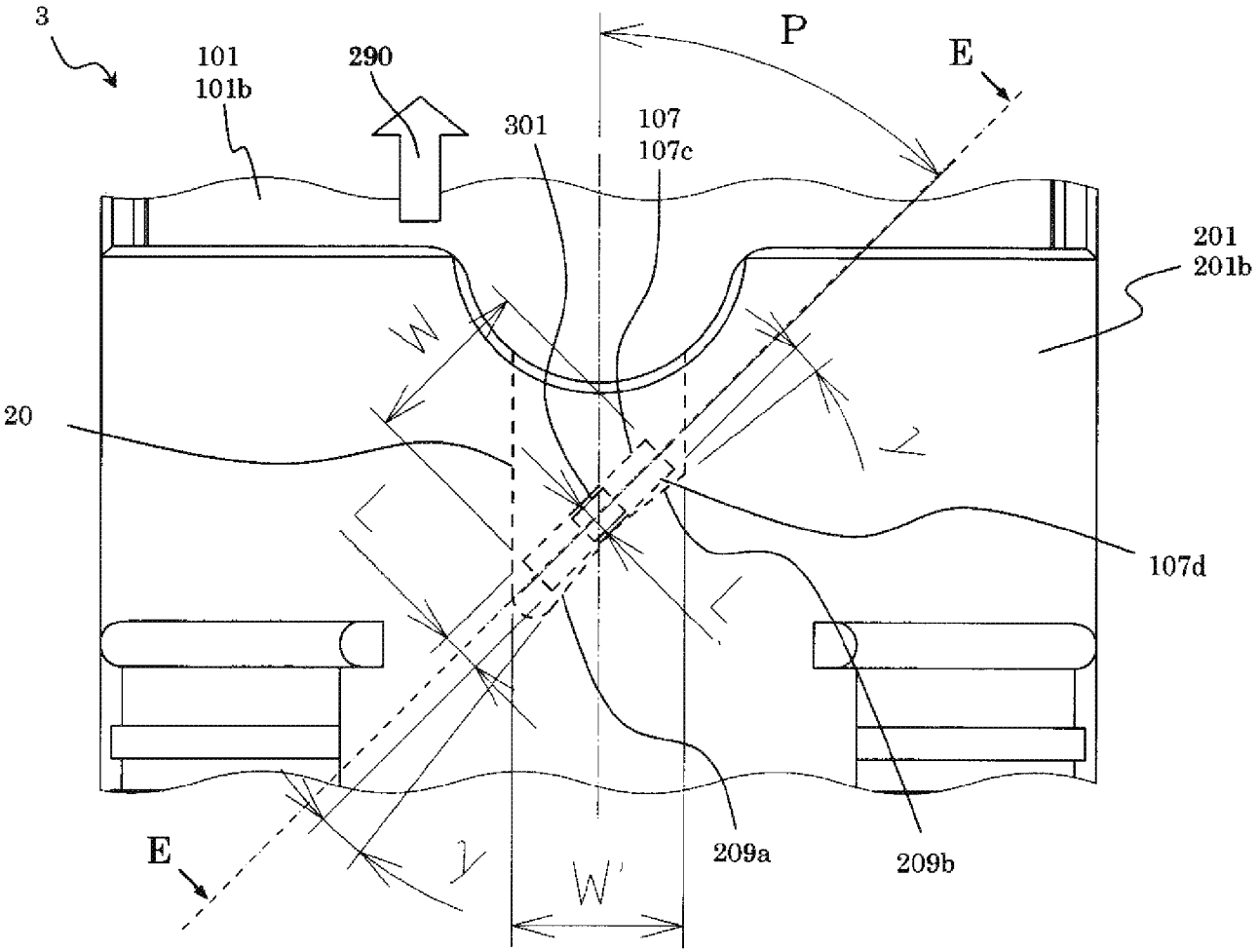
FIG. 24 is a plan view illustrating a shutter movement restriction unit according to a fifth embodiment of the invention.
Figure 25:
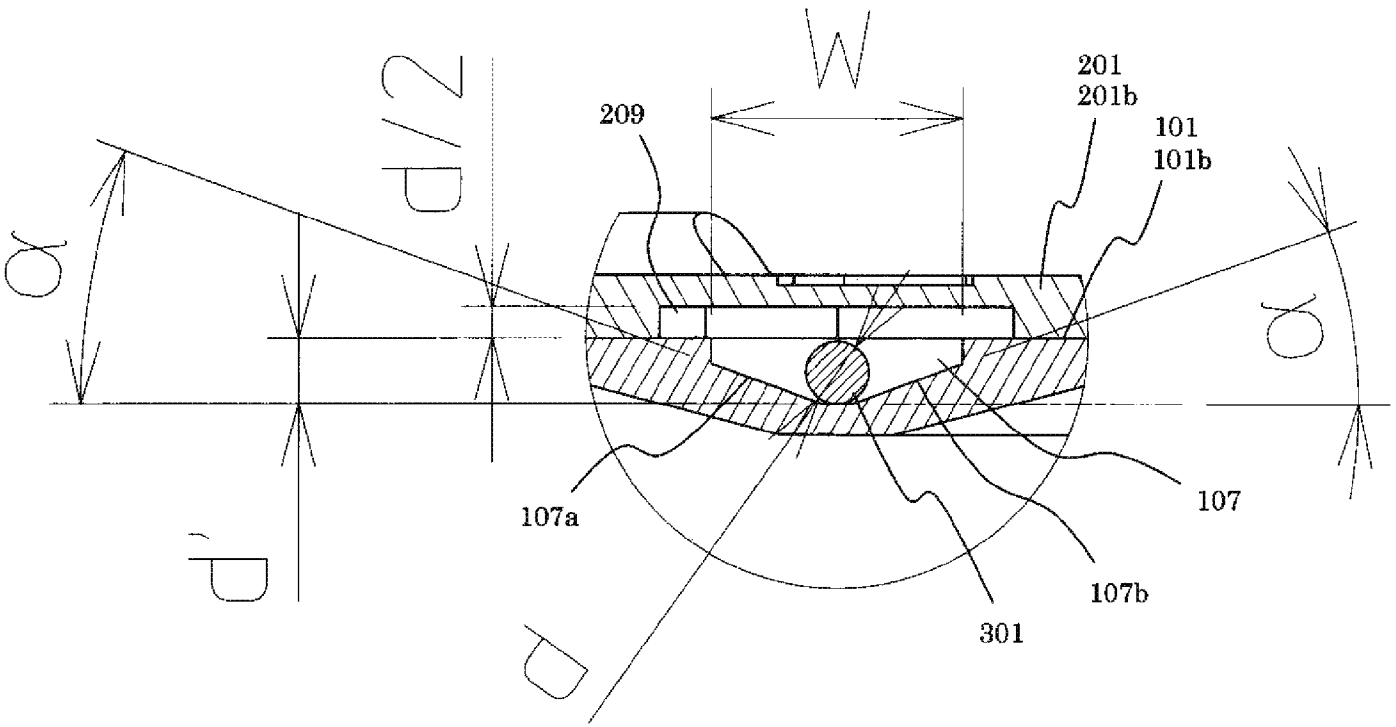
FIG. 25 is a cross sectional view viewed along arrows E-E in FIG. 24.

FIG. 24 is a plan view illustrating a key part of a shutter movement restriction unit according to the fifth embodiment. FIG. 25 is a cross sectional view viewed along arrows E-E of FIG. 24. FIG. 24 illustrates upper surface 101*a* of outer casing 101 viewed from right above, and a direction of arrow 290 indicates the open direction of shutter member 201. FIG. 25 is the cross sectional view viewed along arrows E-E of FIG. 24. The cross sectional view is viewed obliquely at an angle of 45° with respect to the open direction.

As illustrated in FIGS. 24 and 25, toner cartridge 3 includes: first shutter movement restriction groove 107 formed on upper surface 101*b* of outer casing 101; second shutter movement restriction groove 209 formed on upper frame back surface 201*b* of shutter member 201; and pin member 301 as a shutter movement restriction member provided between first shutter movement restriction groove 107 and second shutter movement restriction groove 209. In FIG. 24, first shutter movement restriction groove 107, second shutter movement restriction groove 209, and pin member 301 are illustrated with broken lines since those members are provided inside shutter member 201 as illustrated in FIG. 25.

As similar to the first embodiment, substantially V-shaped first shutter movement restriction groove 107 including inclined surfaces 107*a* and 107*b* at the inclination angle α, extends by a predetermined length L' while inclining at an angle of 45° with respect to the movement direction of shutter member 201. That is, first shutter movement restriction groove 107 is provided oblique to the movement direction of shutter member 201 just at an angle P in FIG. 24. The angle P is an angle of 45° formed by the movement direction and a direction orthogonal to the restriction direction. The oblique angle P may be an angle other than 45°. Cylindrical pin member 301 having a diameter d is disposed between restriction direction end faces 107*c* and 107*d* of first shutter movement restriction groove 107. A preferable length of pin member 301 is L≤d. This is because that length allows pin member 301 to smoothly roll in the width direction of first shutter movement restriction groove 107.

More specifically, first shutter movement restriction groove 107 is inclined at the angle of 45° with respect to the movement direction of shutter member 201. When toner cartridge 3 is inclined by rotating about a central axis in the movement direction of shutter member 201, pin member 301 rolls obliquely. In this case, pin member 301 does not roll smoothly if it is too long. Depth d' of the substantially V-shape center portion of first shutter movement restriction groove 107 is set to a dimension not less than diameter d of cylindrical pin member 301.

Second shutter movement restriction groove 209 having a depth d/2 is provided to a portion of upper frame back surface 201*b* of shutter member 201. The portion faces first shutter movement restriction groove 107 when shutter member 201 is in the close position. Second shutter movement restriction groove 209 is provided to have a width W', whose relationship with width W of first shutter movement restriction groove 107 is W'≥(W+L)×cos 45°, so that second shutter movement restriction groove 209 can entirely cover first shutter movement restriction groove 107. Further, second shutter movement restriction groove 209 has an inclination angle γ such that restriction direction end faces 209*a* and 209*b* get away from restriction direction end face 107*d* of first shutter movement restriction groove 107 while extending on both sides. The inclination angle γ is the same as the inclination angle γ of the fourth embodiment.

In this embodiment, for example, pin member 301 is set with a diameter d=2 mm and length L=1.8 mm. First shutter movement restriction groove 107 is set with an inclination angle α=20°, depth d'=2.2 mm, extension length L'=2 mm, and width W=8 mm. Second shutter movement restriction groove 209 is set with width W'=8 mm, depth d/2=1 mm, and γ=7°.

Next, operation of the shutter movement restriction unit is described.

Figure 26:
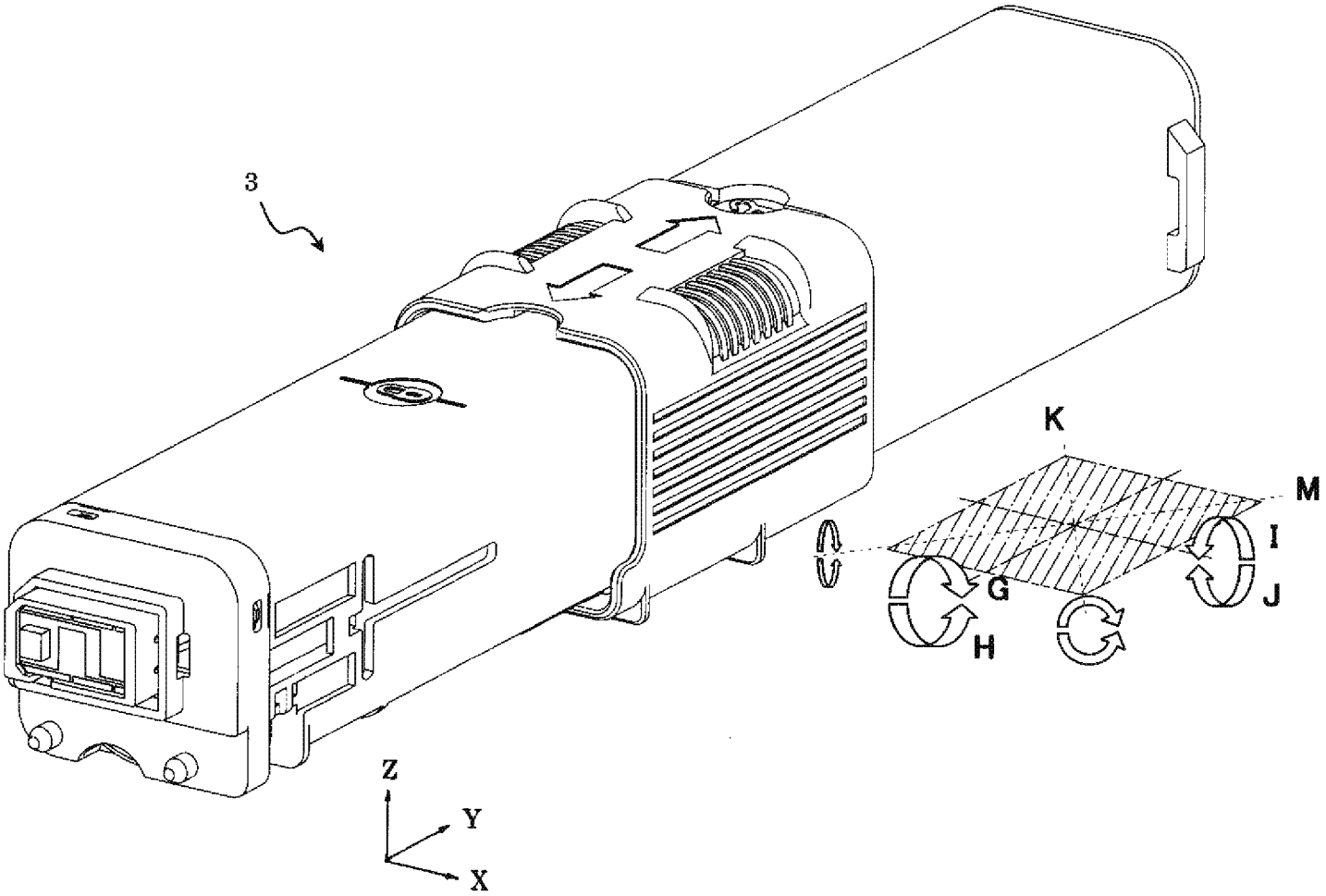
FIG. 26 is an explanatory view illustrating an inclination direction of the toner cartridge.
Figure 27:
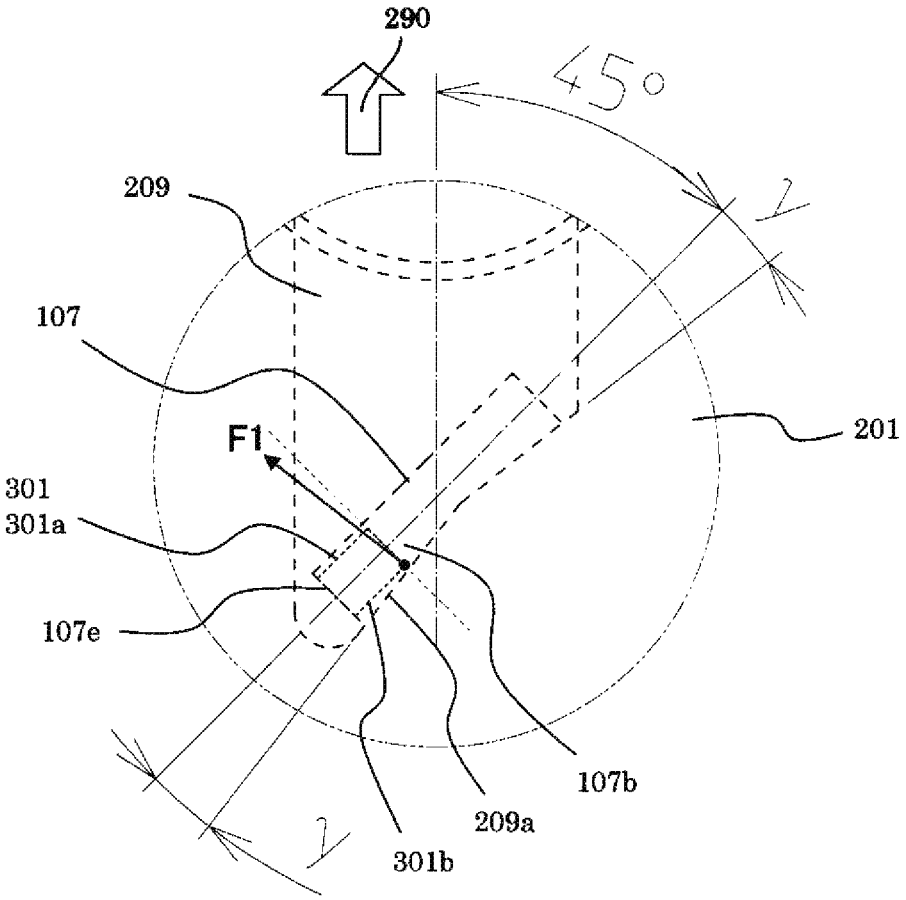
FIG. 27 is a schematic view illustrating operations of the shutter movement restriction unit at an inclination in a G or J direction according to the fifth embodiment.
Figure 28:
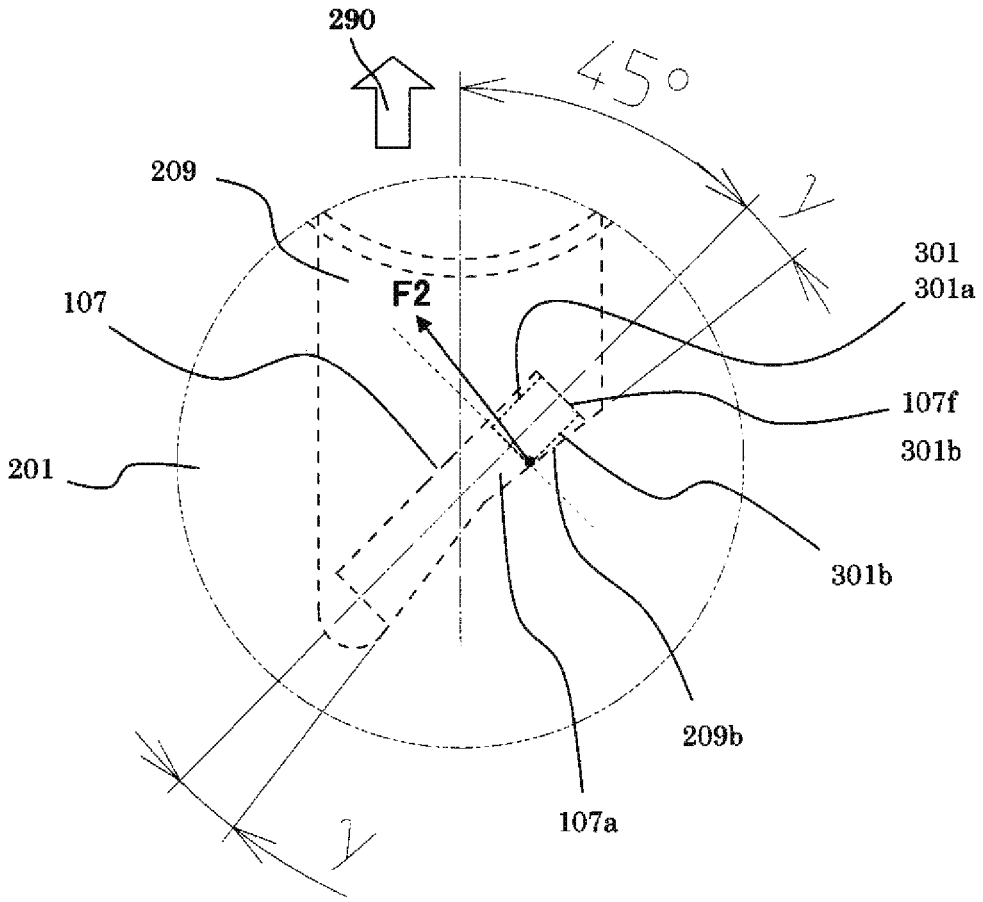
FIG. 28 is a schematic view illustrating operations of the shutter movement restriction unit at an inclination in an H or I direction according to the fifth embodiment.

FIG. 26 is an explanatory view illustrating an inclination direction of toner cartridge 3. FIG. 27 is a schematic view illustrating an operation of the shutter movement restriction unit at an inclination in a G or J direction according to the fifth embodiment. FIG. 28 is a schematic view illustrating an operation of the shutter movement restriction unit at an inclination in an H or I direction according to the fifth embodiment. FIGS. 27 and 28 respectively represent the operations of the shutter movement restriction unit when toner cartridge 3 is inclined in the arrow directions illustrated in FIG. 26.

As illustrated in FIG. 27, when toner cartridge 3 is inclined in the arrow G or J direction of FIG. 26, pin member 301 shifts by rolling on inclined surface 107*b* of first shutter movement restriction groove 107 due to a gravitational action, and rests by abutting to side surface 107*e*. In this state, a semicircular portion of pin member 301 protrudes into a region of second shutter movement restriction groove 209. Thereby, when shutter member 201 is moved in the open direction which is the direction of arrow 290, restriction direction end face 209*a* of second shutter movement restriction groove 209 hits one point of end face 301*b* of pin member 301. The other end face 301*a* of pin member 301 abuts to restriction direction end face 107*c* of first shutter movement restriction groove 107. Thus, pin member 301 serves as a prop, and thereby shutter member 201 cannot be moved further. Thus, a movement of shutter member 201 in the open direction is restricted.

Further, due to the inclination angle γ of restriction direction end face 209*a*, pin member 301 receives a force from restriction direction end face 209*a* in a direction indicated by vector F1, and thereby does not flee toward the center of first shutter movement restriction groove 107 in the width direction. That is, since pin member 301 is pushed by a pressing force (F1×sin γ) to an end portion of first shutter movement restriction groove 107, pin member 301 is firmly held at the end portion and thereby reliably functions as a prop.

As illustrated in FIG. 28, when toner cartridge 3 is inclined in the arrow H or I direction of FIG. 26, pin member 301 shifts by rolling on inclined surface 107*a* of first shutter movement restriction groove 107 due to a gravitational action, and rests by abutting to side surface 107*f*. In this state, a semicircular portion of pin member 301 protrudes into a region of second shutter movement restriction groove 209. Thereby, when shutter member 201 is moved in the open direction being the direction of arrow 290, restriction direction end face 209*b* of second shutter movement restriction groove 209 hits one point of end face 301*b* of pin member 301. The other end face 301*a* of the pin member abuts to restriction direction end face 107*c* of first shutter movement restriction groove 107. Thus, pin member 301 serves as a prop, and thereby shutter member 201 cannot be moved further. In this way, a movement of shutter member 201 in the open direction is restricted. Further, due to the inclination angle γ of restriction direction end face 209*b*, pin member 301 receives a force from restriction direction end face 209*b* in the direction indicated by vector F2, and thereby does not flee toward the center of first shutter movement restriction groove 107 in the width direction. That is, since pin member 301 is pushed by a pressing force (F2×sin γ) to an end portion of first shutter movement restriction groove 107, pin member 301 is firmly held at the end portion and reliably functions as a prop.

Further, even when toner cartridge 3 is inclined simultaneously in more than two arrow directions out of the arrows illustrated in FIG. 26, pin member 301 acts similarly.

In such a manner, even when toner cartridge 3 is inclined from the position of use with respect to the longitudinal axis, the vertical axis or the like, a movement of shutter member 201 in the open direction is restricted. In short, even when an operator holds toner cartridge 3 inclined in any of the various directions, the shutter movement restriction function can be exerted.

According to this embodiment, only when toner cartridge 3 is rotated around the axis in the width direction (in the M direction illustrated in FIG. 26) of first shutter movement restriction groove 107, pin member 301 does not shift and the shutter movement restriction unit does not function. To avoid this, one more shutter movement restriction unit 107 may be disposed beside first shutter movement restriction grooves 107 with their respective restriction directions being orthogonal to each other. That is, two guide paths, which are formed by first shutter movement restriction groove 107 and second shutter movement restriction groove 209, respectively, may be provided in the same surface with their respective restriction directions displaced from each other by a certain angle. The angle might not be a right angle so long as any one of pin members 301 accommodated in the two guide paths can shift reliably. In this case, three or more guide paths may be provided instead of the two guide paths arranged side by side with their restriction directions being orthogonal to each other as described above. Thus, the movement restriction of shutter member 201 can be effective on all rotation axes. The directions of first shutter movement restriction grooves 107 are preferably orthogonal to each other. However, even when the directions are not orthogonal, the shutter movement restriction function may be exerted on an inclination in the M axis direction illustrated in FIG. 26 if the directions are displaced from each other.

As described above, according to the fifth embodiment, first shutter movement restriction groove 107 is disposed to incline at an angle of 45° with respect to the movement direction of shutter member 201. Thus, even when toner cartridge 3 is inclined not only around the longitudinal direction axis but also around any axis, the shutter movement restriction member shifts due to a gravitational action to a position where movement of shutter member 201 is restricted. Accordingly, the movement of shutter member 201 in the open direction of shutter member 201 is reliably blocked. Hence, in any inclination range other than the position of use, a careless operation is prevented from opening the toner supply port, and thereby from scattering the toner. As a result, the reliability of toner cartridge 3 can be enhanced.

Modified Example

Although a toner cartridge comprising a shutter of a sliding type has been described in the above embodiments, the invention may be also applied to a toner cartridge comprising a shutter of a rotating type like the one disclosed in Patent Document 1.

Figure 29:
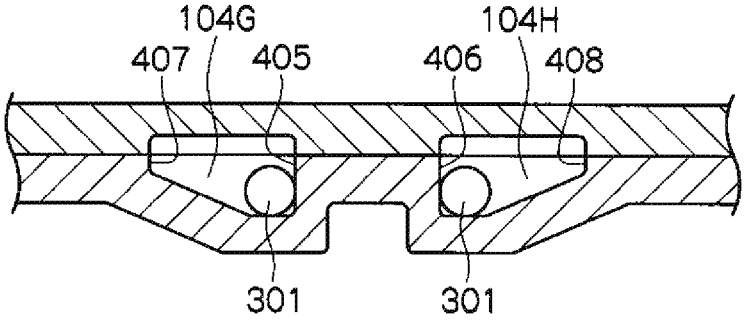
FIG. 29 is a key part enlarged cross sectional view illustrating a first modified example of a first shutter movement restriction groove.
Figure 30:
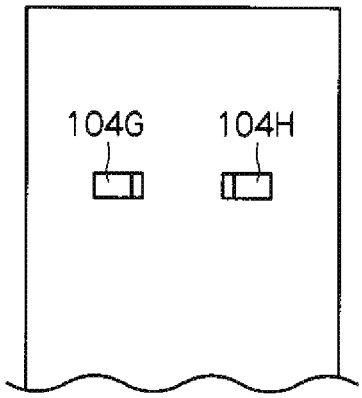
FIG. 30 is a plan view of the first shutter movement restriction groove of FIG. 29.
Figure 31:
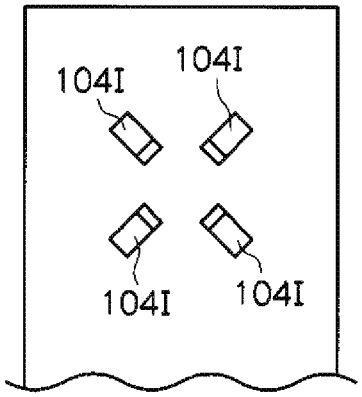
FIG. 31 is a key part enlarged cross sectional view illustrating a second modified example of the first shutter movement restriction groove.

In the embodiments described above, the cross sectional shape of first shutter movement restriction groove 104 is formed in the V shape or curvilinear V shape. However, the cross sectional shape is not limited to these two shapes, but includes any cross sectional shapes, such as a U shape, in which a certain portion is recessed deeply and is connected to an edge (or edges) via an inclined surface (or inclined surfaces). Accordingly, as illustrated in FIG. 29, the cross sectional shape of the groove may be formed by deeply recessing a first edge out of two opposite edges and by connecting the first edge to the second edge of the two edges via an inclined surface, where the first edge represents each of right edge 405 of left first shutter movement restriction groove 104G and left edge 406 of right first shutter movement restriction groove 104H, and the second edge represents each of left edge 407 of left first shutter movement restriction groove 104G and right edge 408 of right first shutter movement restriction groove 104H. In this case, when toner cartridge 3 is inclined to the left, pin member 301 in left first shutter movement restriction groove 104G rolls to left edge 407 to restrict the movement of shutter member 201. When toner cartridge 3 is inclined to the right, pin member 301 in right first shutter movement restriction groove 104H rolls to right edge 408 to restrict the movement of shutter member 201. Right first shutter movement restriction groove 104H and left first shutter movement restriction groove 104G do not necessarily have to be arranged as illustrated in FIG. 29, but the right and left sides may be reversed. The number of shutter movement restriction grooves is not limited to two, and three or more shutter movement restriction grooves may be radially disposed. Specifically, as illustrated in FIG. 30, right first shutter movement restriction groove 104H and left first shutter movement restriction groove 104G may be arranged side by side in a direction orthogonal to the shutter movement direction. Instead, as illustrated in FIG. 31, four first shutter movement restriction grooves 104I equivalent to first shutter movement restriction groove 104G may be provided in a radial direction. The number of the first shutter movement restriction grooves 104I may be three, five or more.

In those cases, the same actions and effects as those of the above embodiments can be obtained.

A pendulum-type member may be used instead of pin member 301 moving in a groove. In this case, first and second shutter movement restriction grooves are provided side by side in an amplitude direction of the pendulum. Thus, when the toner cartridge is inclined, the pendulum swings relative to the grooves and is positioned in both the first and second shutter movement restriction grooves to restrict the movement of shutter element 201. In this way, the same actions and effects as those of the first embodiments also can be obtained.

The invention also may be applied to copiers, facsimile machines, and multifunction machines as well as printers.

Further, the invention is not limited to the embodiments described above, and various modifications are available based on the spirit of the invention and should not be excluded from the scope of the invention. More specifically, various additions, modifications, combinations and partial deletions are available without deviating from conceptual idea of the invention derived from matters specified in the scope of claims and equivalents thereto. Combination and modification of the constituent elements of the invention in the embodiments are also available.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

The invention claimed is:

1. A developer container comprising:

a developer container body including a developer supply port configured to supply a developer stored inside the developer container body to outside the developer container body; and a first shutter movement restriction groove provided on a surface of the developer container body;

a shutter member provided to be movable over a region of the developer container body from a close position to an open position of the developer supply port while being in a sliding contact with the surface where the first shutter movement restriction groove is formed, the shutter member including a second shutter movement restriction groove configured to form a guide path with the first shutter movement restriction groove by facing the first shutter movement restriction groove when the shutter member closes the developer supply port at the close position; and a shutter movement restriction member movably provided in the guide path formed by the first shutter movement restriction groove and the second shutter movement restriction groove, the shutter movement restriction member configured to be positioned in both the first shutter movement restriction groove and the second shutter movement restriction groove depending on an inclination of the developer container body, and thereby to restrict a movement of the shutter member in an open direction from the close position to the open position, wherein the first shutter movement restriction groove has a cross sectional shape in which a central side is recessed deeper than edges on both sides and is connected to the edges on both sides via inclined surfaces.

2. The developer container according to claim 1, wherein the surface where the first shutter movement restriction groove is formed faces upward in a gravitational direction when the developer container body is in a position of use, and the developer container body includes the developer supply port disposed at a position where the developer supply port opens downward in the gravitational direction when the developer container body is in the position of use such that the developer stored inside the developer container body is supplied from inside to outside the developer container body due to gravity.

3. The developer container according to claim 1, wherein the first shutter movement restriction groove has a V-shaped cross sectional shape in which the central side is deeper than both sides.

4. The developer container according to claim 1, wherein the first shutter movement restriction groove has a cross sectional shape in which a deepest portion is provided at a first edge being one of edges on both sides, and the first edge is connected via one inclined surface to a second edge being the other edge of both sides.

5. The developer container according to claim 1, wherein the first shutter movement restriction groove is provided such that a restriction direction in which the first shutter movement restriction groove restricts a movement of the shutter movement restriction member is parallel with a movement direction of the shutter member.

6. The developer container according to claim 1, wherein the first shutter movement restriction groove is provided such that a restriction direction in which the first shutter movement restriction groove restricts a movement of the shutter movement restriction member is oblique to a movement direction of the shutter member.

7. The developer container according to claim 6, wherein the first shutter movement restriction groove is provided such that the restriction direction is inclined at an angle of approximately 45° with respect to the movement direction of the shutter member.

8. The developer container according to claim 1, wherein the shutter movement restriction member comprises a cylindrical member.

9. The developer container according to claim 1, wherein the shutter movement restriction member comprises a spherical member.

10. The developer container according to claim 9, wherein an end face of the second shutter movement restriction groove substantially orthogonal to the open direction of the shutter member has an inclined surface configured to push the shutter movement restriction member into either of edges of the first shutter movement restriction groove when the shutter member is moved in the close direction.

11. The developer container according to claim 9, wherein an end face of the first shutter movement restriction groove substantially orthogonal to the open direction of the shutter member has an inclined surface configured to push the shutter movement restriction member into a shallow portion at either of edges of the first shutter movement restriction groove when the shutter member is moved in the open direction.

12. The developer container according to claim 8, wherein the second shutter movement restriction groove has a depth corresponding to a dimension of a radius of the shutter movement restriction member.

13. The developer container according to claim 1, wherein the first shutter movement restriction groove includes a deepest portion whose depth is not less than a dimension of the shutter movement restriction member, and an inclination surface extending from the deepest portion to a shallowest portion at an edge of the first shutter movement restriction groove has an inclination angle of 10° to 80°, both inclusive, with respect to a horizontal line when the developer container is in the position of use.

14. The developer container according to claim 1, wherein the first shutter movement restriction groove comprises plural first shutter movement restriction grooves disposed radially.

15. The developer container according to claim 1, wherein, the guide path formed by the first shutter movement restriction groove and the second shutter movement restriction groove comprises two or more guide paths arranged on the same surface with the respective restriction directions displaced from each other by a certain angle.

16. A development device comprising the developer container according to claim 1.

17. An image formation apparatus comprising the developer container according to claim 1.

18. A developer container comprising:

a developer container body including a developer supply port configured to supply a developer stored inside the developer container body to outside the developer container body; and a first shutter movement restriction groove provided on a surface of the developer container body;

a shutter member provided to be movable over a region of the developer container body from a close position to an open position of the developer supply port while being in a sliding contact with the surface where the first shutter movement restriction groove is formed, the shutter member including a second shutter movement restriction groove configured to form a guide path with the first shutter movement restriction groove by facing the first shutter movement restriction groove when the shutter member closes the developer supply port at the close position; and a shutter movement restriction member movably provided in the guide path formed by the first shutter movement restriction groove and the second shutter movement restriction groove, the shutter movement restriction member configured to be positioned in both the first shutter movement restriction groove and the second shutter movement restriction groove depending on an inclination of the developer container body, and thereby to restrict a movement of the shutter member in an open direction from the close position to the open position, wherein the second shutter movement restriction groove includes a chevron-shaped guide rib protruding toward the first shutter movement restriction groove such that the guide rib has inclination surfaces substantially parallel with inclination surfaces extending from a deepest portion of the first shutter movement restriction groove toward shallow portions on edges on both sides thereof.

19. A developer container comprising:

a developer container body including a developer supply port configured to supply a developer stored inside the developer container body to outside the developer container body; and a first shutter movement restriction groove provided on a surface of the developer container body;

a shutter member provided to be movable over a region of the developer container body from a close position to an open position of the developer supply port while being in a sliding contact with the surface where the first shutter movement restriction groove is formed, the shutter member including a second shutter movement restriction groove configured to form a guide path with the first shutter movement restriction groove by facing the first shutter movement restriction groove when the shutter member closes the developer supply port at the close position; and a shutter movement restriction member movably provided in the guide path formed by the first shutter movement restriction groove and the second shutter movement restriction groove, the shutter movement restriction member configured to be positioned in both the first shutter movement restriction groove and the second shutter movement restriction groove depending on an inclination of the developer container body, and thereby to restrict a movement of the shutter member in an open direction from the close position to the open position, wherein except when the developer container body is in a position where the developer supply port faces substantially downside in a vertical direction, the shutter movement restriction member is positioned in both the first shutter movement restriction groove and the second shutter movement restriction groove to restrict the movement of the shutter member in the open direction from the close position to the open position.

* * * * *